US009656319B2

(12) United States Patent
Sarh et al.

(10) Patent No.: US 9,656,319 B2
(45) Date of Patent: May 23, 2017

(54) POSITIONING SYSTEM FOR ELECTROMAGNETIC RIVETING

(71) Applicant: The Boeing Company, Chicago, IL (US)

(72) Inventors: Branko Sarh, Huntington Beach, CA (US); Harinder Singh Oberoi, Snohomish, WA (US); Alfredo Jose Gerosa Blanch, Snohomish, WA (US); Kevin Marion Barrick, Kingston, WA (US); Ray Lanier Holden, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 431 days.

(21) Appl. No.: 14/168,259

(22) Filed: Jan. 30, 2014

(65) Prior Publication Data

US 2015/0128394 A1 May 14, 2015

Related U.S. Application Data

(60) Provisional application No. 61/903,544, filed on Nov. 13, 2013.

(51) Int. Cl.
*B21J 15/32* (2006.01)
*B21J 15/14* (2006.01)

(52) U.S. Cl.
CPC ..... *B21J 15/142* (2013.01); *B21J 15/32* (2013.01); *Y10T 29/49815* (2015.01); *Y10T 29/49817* (2015.01); *Y10T 29/49885* (2015.01); *Y10T 29/49888* (2015.01); *Y10T 29/49947* (2015.01); *Y10T 29/49998* (2015.01); *Y10T 29/5377* (2015.01); *Y10T 408/03* (2015.01)

(58) Field of Classification Search
CPC ..... B21J 15/32
USPC ..... 244/131, 132, 119, 120, 123.14, 123.4, 244/131 R; 403/286, 290, 291, 288, 129, 403/109.3, 120, 132, 144, 166, 304, 326, 403/359.4; 29/243.53
See application file for complete search history.

(56) References Cited

U.S. PATENT DOCUMENTS 1,822,217 A * 9/1931 Lafayette ..... F16B 15/00 403/286
3,976,269 A * 8/1976 Gupta ..... B64C 1/12 181/287
4,828,202 A * 5/1989 Jacobs ..... B64C 1/06 118/268
5,029,254 A * 7/1991 Stickney ..... H02B 1/16 174/354

(Continued)

*Primary Examiner* — Monica Carter
*Assistant Examiner* — Mahdi H Nejad
(74) *Attorney, Agent, or Firm* — Yee & Associates, P.C.

(57) ABSTRACT

A method and apparatus for a positioning system for electromagnetic riveting. The apparatus comprises a plate and a biasing system physically associated with the plate. The plate is configured to be positioned relative to a first workpiece, and is further configured to electromagnetically engage an electromagnetic tool. The biasing system is configured to physically engage a second workpiece. The biasing system is further configured to hold the plate in a desired position relative to the first workpiece during a number of operations performed by the electromagnetic tool while the plate is electromagnetically engaged with the first workpiece.

30 Claims, 20 Drawing Sheets

(56) References Cited

U.S. PATENT DOCUMENTS 5,106,037 A * 4/1992 Sherrill ..... B64C 1/12 244/121
5,899,412 A * 5/1999 Dilorio ..... B64C 1/10 244/119
6,073,405 A * 6/2000 Kasai ..... E04B 1/2403 403/270
6,158,666 A * 12/2000 Banks ..... B21J 15/10 105/25
6,536,100 B2 3/2003 Sarh et al.
7,850,387 B2 * 12/2010 Chapin ..... B64C 1/12 403/286
8,353,479 B2 * 1/2013 Tacke ..... B64C 1/061 244/119
8,453,975 B2 * 6/2013 Dietrich ..... B64C 1/061 244/119
8,480,030 B2 * 7/2013 Stephan ..... B64C 1/12 244/117 R
8,528,865 B2 * 9/2013 Tacke ..... B64C 1/064 244/131
8,656,677 B2 * 2/2014 Kernmayer ..... B60R 13/02 244/120
2003/0207742 A1 * 11/2003 Hazlehurst ..... B21C 51/005 483/36
2004/0016097 A1 * 1/2004 Bloch ..... B21J 15/142 29/407.1
2006/0060705 A1 * 3/2006 Stulc ..... B64C 1/069 244/119
2010/0282905 A1 * 11/2010 Cazeneuve ..... B64C 1/06 244/120
2011/0024561 A1 * 2/2011 Kofinger ..... B64C 1/066 244/119
2011/0095130 A1 * 4/2011 Luettig ..... B64C 1/064 244/119
2015/0337883 A1 * 11/2015 Corden ..... F16B 5/02 403/286

* cited by examiner

POSITIONING SYSTEM FOR ELECTROMAGNETIC RIVETING

RELATED PROVISIONAL APPLICATION

This application claims the benefit of U.S. Provisional Patent Application Ser. No. 61/903,544, filed Nov. 13, 2013, and entitled "Positioning System for Electromagnetic Riveting."

BACKGROUND INFORMATION

1. Field

The present disclosure relates generally to aircraft and, in particular, to manufacturing aircraft. Still more particularly, the present disclosure relates to a method and apparatus for a positioning system for electromagnetic riveting.

2. Background

In manufacturing structures, different parts may be connected to each other to form the structures. Aircraft structures may include, for example, without limitation, a wing and a fuselage of an aircraft. These and other aircraft structures may be manufactured by attaching parts to each other to form aircraft assemblies.

For example, without limitation, skin panels may be placed onto frames and stringers to form a fuselage. Skin panels also may be attached onto spars and ribs to form a wing for the aircraft. These skin panels and structural elements form an exterior surface for the aircraft.

When joining panels of a fuselage together, one skin panel may be positioned to overlap with another skin panel and may be secured to each other using fasteners to form a joint between the skin panels. This joint may be commonly referred to as a lap joint. The fasteners used to form the joint may take the form of rivets.

In some instances, several rows of rivets may be used to attach one skin panel to another skin panel. Additionally, longitudinal stringers may be positioned along the joint and may be secured to the panels with a row of rivets.

The attachment of fuselage skin panels and other parts to each other, as well as other operations, may be performed in a number of different ways. For example, without limitations, human operators or computer-controlled machines may perform these operations. With human operators, two operators may be located opposite to each other on a workpiece, such as a group of skin panels for the fuselage. The operators may install clamping devices to hold the skin panels together. Thereafter, a drill may be used by one of the operators to create a hole. A rivet or other type of fastener may then be installed into the hole.

Large computer-controlled machines also may be used to drill holes and install rivets to fasten the parts to each other. In some cases, an electromagnetic tool may be used to clamp panels together and install rivets in a desired manner. With electromagnetic riveting, an electromagnetic unit may engage magnetic material on the panels and provide force to hold the panels in a desired position.

When attaching skin panels and other aircraft structures to one another, maintaining desired dimensions, positions, and configurations of the structures may be desired. For instance, positioning systems may be installed between stringers and frames to hold these structures in a desired position. These positioning systems may include a backing plate to hold structures during operation of the riveting tool. These positioning systems also may guide the riveting tool to drill holes and place rivets in a desired manner.

In some cases, however, maintaining the desired positions and configurations of structures relative to one another using positioning systems may be more difficult, costly, or time-consuming than desired. Therefore, it would be desirable to have a method and apparatus that take into account at least some of the issues discussed above, as well as other possible issues.

SUMMARY

In one illustrative embodiment, an apparatus may comprise a plate and a biasing system physically associated with the plate. The plate may be configured to be positioned relative to a first workpiece. The plate may be further configured to electromagnetically engage an electromagnetic tool. The biasing system may be configured to physically engage a second workpiece. The biasing system may be further configured to hold the plate in a desired position relative to the first workpiece during a number of operations performed by the electromagnetic tool while the plate is electromagnetically engaged with the first workpiece.

In another illustrative embodiment, a system may comprise an electromagnetic tool, a first plate, a first biasing system physically associated with the plate, a second plate configured to engage with the first plate at an interface, a second biasing system physically associated with the second plate, and a group of connecting brackets coupled to the first plate and the second plate. The electromagnetic tool may be configured to perform a number of operations on a first workpiece and a second workpiece. The number of operations may be selected from at least one of drilling a hole, installing a fastener in the hole, countersinking a hole, or applying a coating to a surface of the first workpiece. The electromagnetic tool may be an electromagnetic riveting tool. The first workpiece may be a skin of a fuselage and the second workpiece may be a structural portion of the fuselage. The first plate may be configured to be positioned relative to the first workpiece in a position selected from at least one of being in contact with the surface of the first workpiece and a desired distance from the first workpiece. The first plate may be further configured to electromagnetically engage the electromagnetic tool. The plate may be a backing plate and may further comprise a plurality of openings in the backing plate. The plurality of openings may be configured to receive a number of fasteners during operation of the electromagnetic tool. The first biasing system may be configured to physically engage the second workpiece and hold the plate in a desired position relative to the first workpiece and the second workpiece in a number of directions during the number of operations performed by the electromagnetic tool while the plate is electromagnetically engaged with the first workpiece and the second workpiece. The biasing system may comprise a number of springs configured into pairs of springs and may be used to stabilize the plate in a number of directions by locking the biasing system in place with a number of structures in the second workpiece. Each pair of springs may be configured to stabilize the plate in a respective direction selected from at least one of an x-direction, a y-direction, or a z-direction. A spring in the number of springs may be selected from one of a plate spring, a compression spring, a torsion spring, a flat spring, a leaf spring, a coil spring, a helical spring, or a cantilever spring. The first biasing system may stabilize the plate against the number of structures in the second workpiece. The number of structures may be selected from at least one of a stringer, a frame, or a shear tie. The second biasing system may be configured to hold the second plate in the desired position relative to the first workpiece and the second workpiece during the number of operations performed by the electromagnetic tool. The group of connecting brackets may be configured to stabilize the first plate relative to at least one of the second workpiece or the second plate. The first plate, the second plate, the first biasing system, the second biasing system, and the group of connecting brackets may comprise a positioning system.

In yet another illustrative embodiment, a method for performing a number of operations on a first workpiece with an electromagnetic tool may be presented. A biasing system may be physically engaged with a second workpiece in which a plate physically associated with the biasing system may be held in a desired position relative to the first workpiece. The plate may be electromagnetically engaged with the electromagnetic tool. The number of operations may be performed on the first workpiece while the plate is electromagnetically engaged with the electromagnetic tool.

In yet another illustrative embodiment, a method for performing a number of operations with an electromagnetic tool may be presented. A biasing system may be physically engaged with a second workpiece including locking a number of springs of the biasing system in place with a number of structures in the second workpiece, in which a plate physically associated with the biasing system may be held in a desired position relative to a first workpiece to stabilize the plate against the number of structures in the second workpiece selected from at least one of a stringer, a frame, or a shear tie. The biasing system may comprise the number of springs physically associated with the plate and may be configured to hold the plate in a desired position relative to the first workpiece in a number of directions. The number of springs may be configured into pairs of springs. Each pair of springs in the number of springs may be configured to stabilize the plate in a respective direction selected from at least one of an x-direction, a y-direction, or a z-direction. The plate may be electromagnetically engaged with the electromagnetic tool. The plate may comprise a plurality of openings configured to receive a number of fasteners in which the plate is a first plate. A second plate physically associated with a second biasing system may be positioned relative to the first plate. A group of connecting brackets may be coupled to the first workpiece and the second plate and may be configured to stabilize the first plate relative to at least one of the second plate and the second workpiece. A number of operations may be performed on the first workpiece while the plate is electromagnetically engaged with an electromagnetic tool. Performing the number of operations may comprise guiding the number of fasteners through the plurality of openings in the plate to form a joint between the first workpiece and the second workpiece using the electromagnetic tool. The number of operations may be performed on the second workpiece while the plate is electromagnetically engaged with the electromagnetic tool. Performing the number of operations on the first workpiece and the second workpiece may comprise drilling holes in a first portion and a second portion of the first workpiece; countersinking the holes; and installing fasteners in the holes such that the first portion of the first workpiece is secured to the second portion of the first workpiece to form a lap joint. The first plate, the second plate, and the biasing system may be removed from the first workpiece and the second workpiece.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For instance, the illustrative embodiments recognize and take into account that it may be desirable to provide a positioning system for use during electromagnetic riveting that may not need to be fastened to the workpiece using pins or screws that may penetrate the workpiece. The illustrative embodiments also recognize and take into account that installing and removing positioning systems that are fastened to the workpiece may take more time than desired. For instance, two human operators may be needed to install or remove the fastened positioning system, one on the inside and one on the outside of the workpiece.

The illustrative embodiments recognize and take into account, however, that the use of multiple human operators may be more costly than desired. Moreover, installation and removal of these positioning systems may delay the manufacturing process of the aircraft when installation and removal take more time than desired.

The illustrative embodiments also recognize and take into account that it may be desirable to provide a positioning system that does not affect the structural integrity of the workpiece. For example, without limitation, a positioning system that may not be fastened to the workpiece may improve the structural integrity of the workpiece since no unneeded holes for pins, screws, or other fasteners may be placed in the workpiece.

Moreover, the illustrative embodiments also recognize and take into account that some currently used fastener installation systems may require more steps than desired. For instance, in some cases, fastener installation systems may require drilling through the interface of one or more workpieces, separating and deburring each surface of the workpieces, sealing faying surfaces separately, realigning drilled holes in the workpieces, and installing the fasteners, among other intermediate steps. This process may take much longer than desired.

Thus, the illustrative embodiments may provide a method and apparatus for performing operations using an electromagnetic tool. These operations may include, for example, without limitation, electromagnetic riveting. An apparatus may comprise a plate and a biasing system. The biasing system may be physically associated with the plate. The plate may be configured to be positioned relative to a first workpiece and to electromagnetically engage an electromagnetic tool. The biasing system may be configured to physically engage a second workpiece. The biasing system may be further configured to hold the plate in a desired position relative to the first workpiece during a number of operations performed by the electromagnetic tool while the plate is electromagnetically engaged with the first workpiece.

Figure 1:
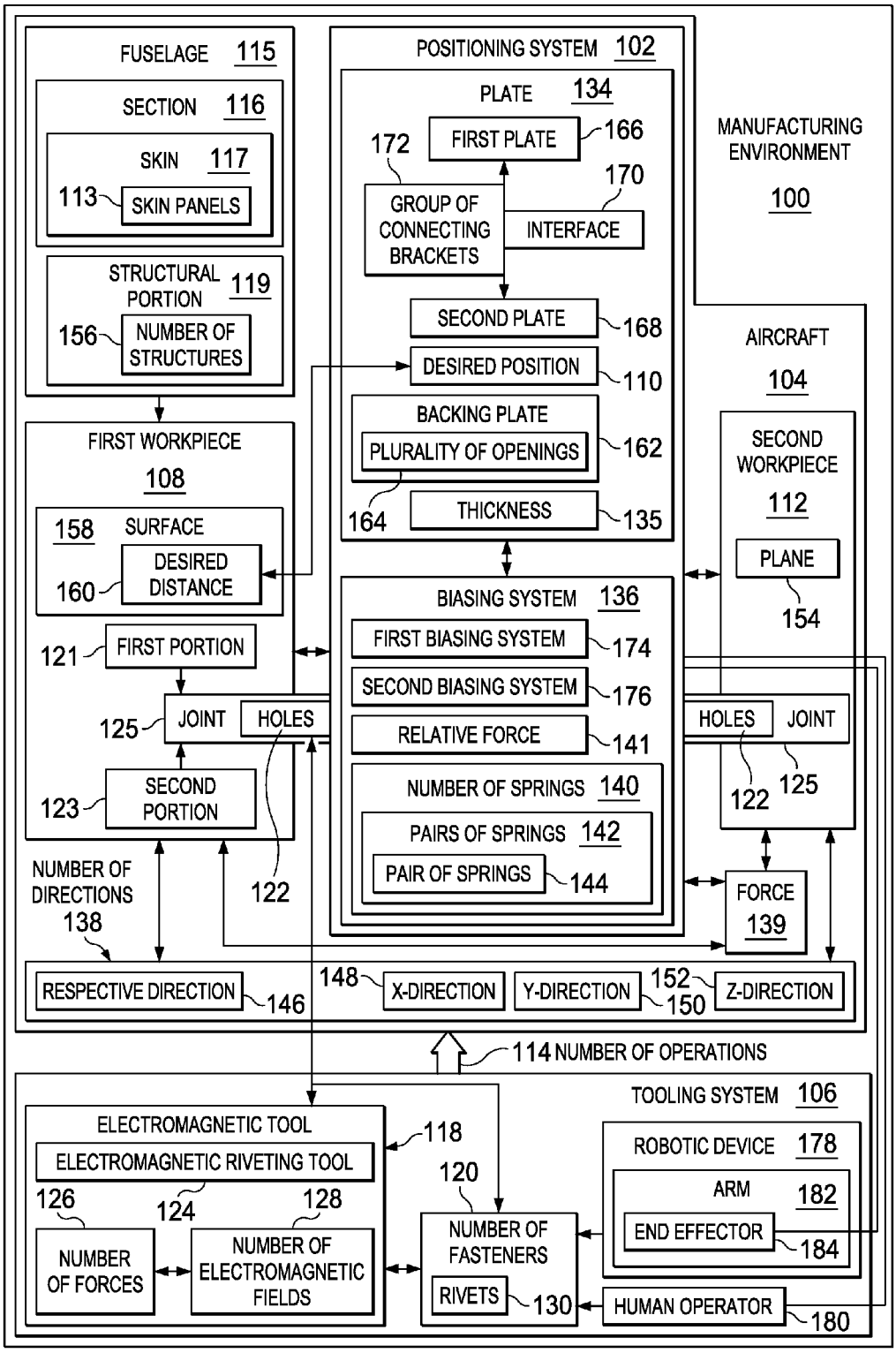
FIG. 1 is an illustration of a block diagram of a manufacturing environment in accordance with an illustrative embodiment.

Referring now to the figures and, in particular, with reference to FIG. 1, an illustration of a block diagram of a manufacturing environment is depicted in accordance with an illustrative embodiment. In this depicted example, manufacturing environment 100 is an example of an environment in which positioning system 102 may be used. In particular, positioning system 102 may be used during various stages of manufacturing of aircraft 104 in manufacturing environment 100.

As illustrated, manufacturing environment 100 may include positioning system 102 and tooling system 106. In this illustrative example, positioning system 102 may be configured to hold first workpiece 108 in desired position 110 relative to second workpiece 112 during manufacturing of aircraft 104.

In this illustrative example, at least one of first workpiece 108 or second workpiece 112 may be a piece of metal, composite, ceramic, or other material that is in the process of being worked on. In some examples, at least one of first workpiece 108 or second workpiece 112 may be made, assembled, cut out, or otherwise formed using tooling system 106 or another suitable type of machine or tool.

As used herein, the phrase "at least one of," when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required.

For example, without limitation, "at least one of item A, item B, and item C" may mean item A; item A and item B; item B; item A, item B, and item C; or item B and item C. In some cases, "at least one of item A, item B, and item C" may mean, for instance, without limitation, two of item A, one of item B, and ten of item C; four of item B and seven of item C; or some other suitable combination.

First workpiece 108, second workpiece 112, and additional workpieces (not shown) may be assembled to form aircraft 104 in these illustrative examples. In this instance, first workpiece 108 and second workpiece 112 may be assembled to form section 116 of fuselage 115 of aircraft 104.

In this illustrative example, section 116 of fuselage 115 of aircraft 104 may be comprised of skin 117 and structural portion 119. Skin 117 may include one or more skin panels 113.

As illustrated, structural portion 119 may be comprised of a number of different types of components. For instance, structural portion 119 may be comprised of at least one of frames, shear ties, stringers, and other suitable structural components.

In this depicted example, first workpiece 108 may form skin 117 in section 116 of fuselage 115 of aircraft 104. First workpiece 108 may include first portion 121 and second portion 123. First portion 121 and second portion 123 may be skin panels 113 that form skin 117 in section 116 of fuselage 115 of aircraft 104 in this illustrative example. In other words, each portion includes some of skin panels 113.

As depicted, first portion 121 and second portion 123 of first workpiece 108 may be positioned such that first portion 121 and second portion 123 overlap one another. First portion 121 and second portion 123 may then be attached to form joint 125. In some illustrative examples, second workpiece 112 also may be attached to first portion 121 and second portion 123 at joint 125.

In this depicted example, tooling system 106 may be configured to perform number of operations 114 on at least one of first workpiece 108 and second workpiece 112. As used herein, a "number of" items may be one or more items.

For example, without limitation, number of operations 114 means one or more operations. In this illustrative example, number of operations 114 may be selected from at least one of drilling a hole, installing a fastener in the hole, countersinking a hole, applying a coating to a surface of at least one of first workpiece 108 or second workpiece 112, or some other suitable operation.

As illustrated, tooling system 106 may include electromagnetic tool 118. Electromagnetic tool 118 may be configured to perform number of operations 114 on at least one of first workpiece 108 or second workpiece 112. For instance, electromagnetic tool 118 may attach first workpiece 108 to second workpiece 112 using number of fasteners 120.

In this depicted example, number of fasteners 120 may take a number of forms. For example, without limitation, number of fasteners 120 may be selected from at least one of a rivet, a nut and bolt, a screw, or some other suitable type of fastener.

In this illustrative example, electromagnetic tool 118 may be configured to activate such that number of forces 126 may be caused by number of electromagnetic fields 128. The activation of number of forces 126 may clamp first workpiece 108 between electromagnetic tool 118 and positioning system 102. Electromagnetic tool 118 may be configured to perform number of operations 114 once electromagnetic tool 118 is activated and first workpiece 108 is clamped between electromagnetic tool 118 and positioning system 102.

For instance, electromagnetic tool 118 may drill and countersink holes 122 to install number of fasteners 120 in first workpiece 108 and second workpiece 112 while first workpiece 108 is clamped between electromagnetic tool 118 and positioning system 102. In this manner, movement of first workpiece 108 may be reduced while number of operations 114 is being performed on first workpiece 108 and second workpiece 112.

In this depicted example, electromagnetic tool 118 may be electromagnetic riveting tool 124. Electromagnetic riveting tool 124 may be configured to install rivets 130 in holes 122 to attach first portion 121 and second portion 123 of first workpiece 108 to each other, attach first workpiece 108 to second workpiece 112, or both.

In this illustrative example, positioning system 102 may be configured to hold first workpiece 108 in desired position 110 as electromagnetic tool 118 performs number of operations 114 on at least one of first workpiece 108 and second workpiece 112. For instance, positioning system 102 may hold first workpiece 108 in desired position 110 as electromagnetic tool 118 drills holes 122 in first workpiece 108 and second workpiece 112.

As illustrated, positioning system 102 may be comprised of a number of different components. In this depicted example, positioning system 102 may include plate 134 and biasing system 136. Plate 134 may be configured to be positioned relative to first workpiece 108 and electromagnetically engage electromagnetic tool 118. In this illustrative example, plate 134 may electromagnetically engage with electromagnetic tool 118 when electromagnetic tool 118 is activated such that number of forces 126 clamp first workpiece 108 between electromagnetic tool 118 and plate 134.

As depicted, plate 134 may be comprised of various types of material. For example, without limitation, plate 134 may be comprised of a metal, a metal alloy, or some other suitable type of material that is configured to electromagnetically engage with electromagnetic tool 118.

In this illustrative example, plate 134 may have thickness 135. Thickness 135 may be a thickness selected from about one quarter inch to about one inch. Thickness 135 may be selected such that plate 134 electromagnetically engages with electromagnetic tool 118 in a desired manner. For instance, thickness 135 may be selected to position plate 134 in desired position 110 relative to first workpiece 108.

In this depicted example, biasing system 136 may be associated with plate 134. As used herein, when one component is "associated" with another component, the association is a physical association in the depicted examples. For example, without limitation, a first component, such as biasing system 136, may be considered to be associated with a second component, such as plate 134, by at least one of being secured to the second component, bonded to the second component, mounted to the second component, welded to the second component, fastened to the second component, or connected to the second component in some other suitable manner.

The first component also may be connected to the second component using a third component. Further, the first component may be considered to be associated with the second component by being formed as part of the second component, as an extension of the second component, or both.

As depicted, biasing system 136 may be configured to engage second workpiece 112 and hold plate 134 in desired position 110 relative to first workpiece 108 during number of operations 114 performed by electromagnetic tool 118 while plate 134 is electromagnetically engaged with first workpiece 108. In particular, biasing system 136 may be configured to physically engage second workpiece 112 and hold plate 134 in desired position 110 relative to first workpiece 108 in number of directions 138.

In this depicted example, biasing system 136 may be comprised of a number of different materials. For example, without limitation, biasing system 136 may be comprised of one or more materials selected from at least one of a metal, a metal alloy, or some other suitable type of material.

In this illustrative example, biasing system 136 may be installed in second workpiece 112 and configured to store mechanical energy. In one illustrative example, second workpiece 112 applies force 139 against biasing system 136 to hold plate 134 in place relative to first workpiece 108. First workpiece 108 also may apply force 139 against biasing system 136. In response, biasing system 136 applies reactive force 141 to at least one of first workpiece 108 or second workpiece 112 to hold plate 134 in place.

As depicted, biasing system 136 may comprise number of springs 140. Number of springs 140 may be configured to stabilize plate 134 in number of directions 138. In other illustrative examples, biasing system 136 may comprise some other type of biasing system, depending on the particular implementation. For example, without limitation, biasing system 136 may comprise hydraulics, a dashpot, or other suitable types of devices.

As illustrated, biasing system 136 may stabilize plate 134 against number of structures 156 in second workpiece 112. In this illustrative example, number of structures 156 may be selected from at least one of a stringer, a frame, a shear tie, or some other suitable structure.

In this depicted example, number of springs 140 may take various forms. For example, without limitation, number of springs 140 may be selected from at least one of a plate spring, a compression spring, a torsion spring, a flat spring, a leaf spring, a coil spring, a helical spring, a cantilever spring, or some other suitable type of spring.

As depicted, number of springs 140 may be configured into pairs of springs 142. For instance, in this illustrative example, pair of springs 144 may be associated with plate 134.

In this depicted example, pair of springs 144 may be two springs arranged along plate 134 such that one spring in pair of springs 144 is opposite to the other spring. For example, without limitation, one spring in pair of springs 144 may be arranged on one end of plate 134 and the other spring in pair of springs 144 may be arranged on the opposite end of plate 134. In this manner, pair of springs 144 may stabilize plate 134 in respective direction 146.

In this illustrative example, respective direction 146 may be selected from at least one of x-direction 148, y-direction 150, and z-direction 152. Accordingly, each one of pairs of springs 142 may stabilize plate 134 in at least one of x-direction 148, y-direction 150, and z-direction 152. X-direction 148, y-direction 150, and z-direction 152 may be expressed with respect to plane 154 of second workpiece 112 in this illustrative example.

As depicted, force 139 may be applied to number of springs 140 by at least one of first workpiece 108 or second workpiece 112 in number of directions 138. For instance, second workpiece 112 may apply force 139 on each one of pairs of springs 142 in one of number of directions 138. Each one of pairs of springs 142 may then apply reactive force 141 to second workpiece 112 to stabilize plate 134 in desired position 110 in these illustrative examples.

In this depicted example, desired position 110 for plate 134 may be selected from at least one of being in contact with surface 158 of first workpiece 108, desired distance 160 from surface 158, or some other suitable position. In some examples, desired position 110 may be selected such that plate 134 electromagnetically engages with first workpiece 108 in a desired manner during number of operations 114. For instance, plate 134 may be arranged desired distance 160 from surface 158 of first workpiece 108 such that plate 134 electromagnetically engages with first workpiece 108 when electromagnetic tool 118 is at a desired activation for electromagnetic tool 118.

As illustrated, plate 134 may be backing plate 162. Backing plate 162 may include plurality of openings 164 arranged in backing plate 162. In this illustrative example, plurality of openings 164 may be configured to receive number of fasteners 120 during operation of electromagnetic tool 118. In other illustrative examples, plurality of openings 164 may guide drilling of holes 122 for number of fasteners 120 by electromagnetic tool 118, or during other of number of operations 114.

In some illustrative examples, more than one plate may be present in positioning system 102. For example, without limitation, positioning system 102 may comprise first plate 166 and second plate 168. Second plate 168 may be configured to engage with first plate 166 at interface 170.

As illustrated, first plate 166 and second plate 168 may engage at interface 170 such that first plate 166 and second plate 168 are removably connected to one another. Interface 170 may stabilize first plate 166 and second plate 168 relative to one another.

Interface 170 of first plate 166 may receive second plate 168 in this illustrative example. In other illustrative examples, first plate 166 and second plate 168 may snap together. In still other illustrative examples, first plate 166 and second plate 168 may lock in place in some other suitable manner.

In one illustrative example, first plate 166 and second plate 168 may be positioned side by side. In another illustrative example, first plate 166 may be positioned above or below second plate 168. In still other illustrative examples, first plate 166 and second plate 168 may be positioned in another manner, depending on the functionality involved.

When first plate 166 and second plate 168 are arranged vertically with respect to one another, group of connecting brackets 172 may be coupled to first plate 166 and second plate 168. Group of connecting brackets 172 may be configured to stabilize first plate 166 relative to at least one of first workpiece 108 or second plate 168. In other words, group of connecting brackets 172 connects first plate 166 to second plate 168 in a desired manner such that first plate 166 and second plate 168 may not move. In some illustrative examples, when first plate 166 and second plate 168 are arranged vertically with respect to one another, interface 170 may be omitted or may not be used to lock first plate 166 and second plate 168 in place.

When first plate 166 and second plate 168 are present in positioning system 102, first biasing system 174 and second biasing system 176 also may be present in positioning system 102. First biasing system 174 may be physically associated with first plate 166, while second biasing system 176 may be physically associated with second plate 168.

As illustrated, first biasing system 174 may be configured to hold first plate 166 in desired position 110 relative to first workpiece 108 during number of operations 114 performed by electromagnetic tool 118. In a similar fashion, second biasing system 176 may be configured to hold second plate 168 in desired position 110 relative to first workpiece 108 during number of operations 114 performed by electromagnetic tool 118.

In this illustrative example, at least one of robotic device 178 and human operator 180 may position plate 134 with biasing system 136 in second workpiece 112. Additionally, at least one of robotic device 178 and human operator 180 also may perform number of operations 114 and subsequently remove plate 134 and biasing system 136 from second workpiece 112. In this illustrative example, robotic device 178 may be arm 182 with end effector 184.

In one illustrative example, human operator 180 may position plate 134 with biasing system 136 relative to first workpiece 108 by engaging number of springs 140 with second workpiece 112. Robotic device 178 may then perform number of operations 114 on first workpiece 108 and second workpiece 112 using electromagnetic tool 118.

For instance, electromagnetic tool 118 may be placed on end effector 184 of arm 182. Electromagnetic tool 118 may then be activated to electromagnetically engage plate 134 and first workpiece 108, perform number of operations 114 such as drilling and countersinking holes 122, and installing rivets 130 in holes 122. In other illustrative examples, plate 134 with biasing system 136 may be positioned by robotic device 178 prior to activating electromagnetic tool 118. In still other illustrative examples, human operator 180 may drill holes 122, countersink holes 122, and install rivets 130. Plate 134 with biasing system 136 may then be removed from second workpiece 112.

In this manner, plate 134 with biasing system 136 may hold first workpiece 108 in desired position 110 while electromagnetic tool 118 may perform number of operations 114. Because biasing system 136 may have number of springs 140, biasing system 136 may be more easily engaged with second workpiece 112 than currently used positioning systems that may be secured to one of first workpiece 108 and second workpiece 112 using fasteners.

In this depicted example, after electromagnetic tool 118 completes number of operations 114, plate 134 with number of springs 140 may be more easily removed from second workpiece 112 than currently used positioning systems where fasteners need to be removed. Moreover, additional holes 122 may not be needed in first workpiece 108 such that the structural integrity of first workpiece 108 may be maintained at a desired level.

The illustration of positioning system 102 in manufacturing environment 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, without limitation, number of springs 140 may be positioned along only one side of plate 134. In other illustrative examples, number of springs 140 may not be configured in pairs of springs 142. Instead, number of springs 140 may be arranged such that each one of number of springs 140 offsets one another.

In still other illustrative examples, additional plates also may be engaged with first plate 166 and second plate 168. For instance, three plates, six plates, ten plates, or some other number of plates may be engaged with first plate 166 and second plate 168.

Figure 2:
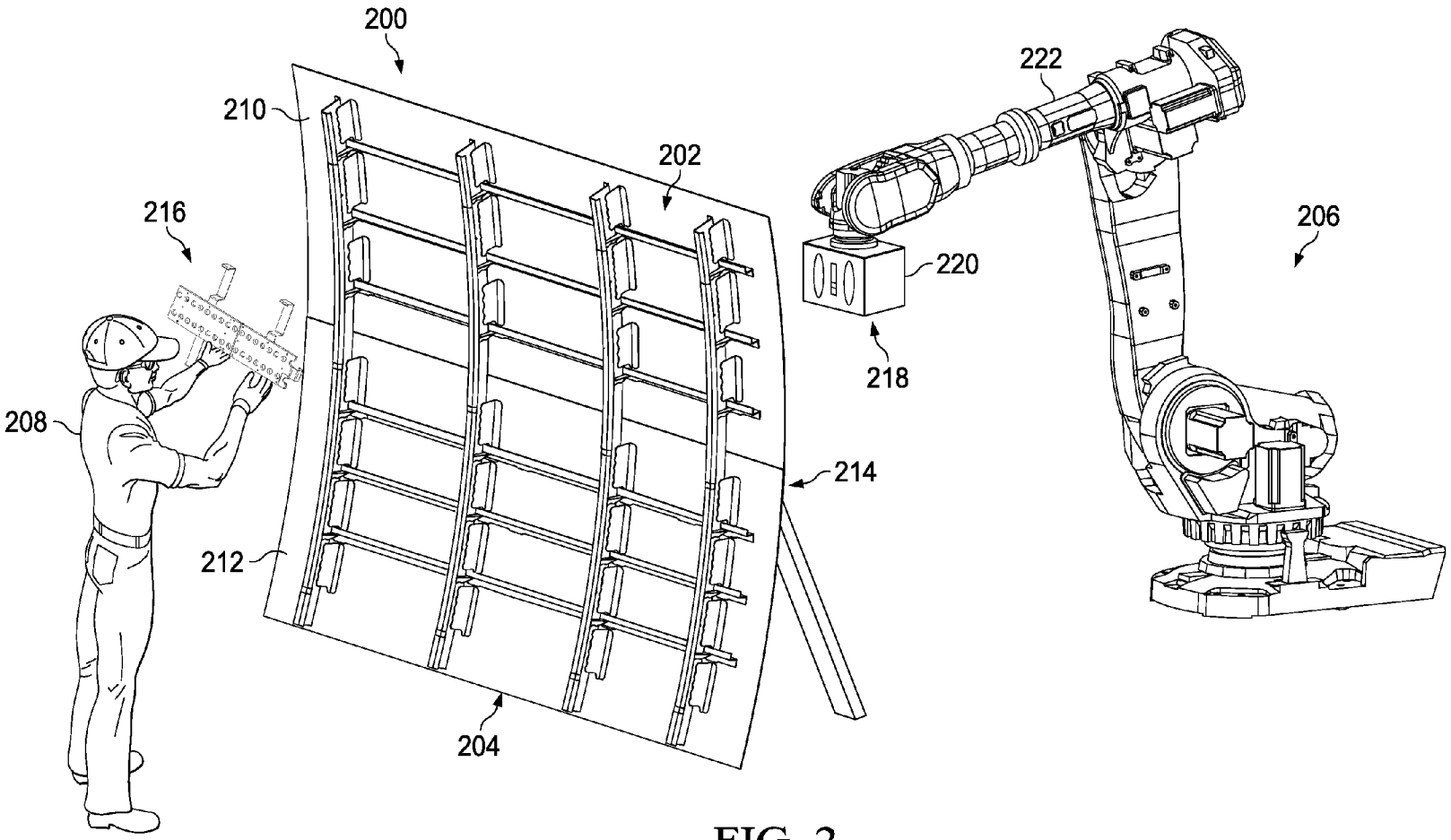
FIG. 2 is an illustration of a manufacturing environment in accordance with an illustrative embodiment.

With reference now to FIG. 2, an illustration of a manufacturing environment is depicted in accordance with an illustrative embodiment. Manufacturing environment 200 may be an example of a physical implementation of manufacturing environment 100 shown in block form in FIG. 1.

As depicted, manufacturing environment 200 includes first workpiece 202, second workpiece 204, robotic device 206, and human operator 208. First workpiece 202 may be physical implementation for first workpiece 108, while second workpiece 204, robotic device 206, and human operator 208 may be an implementation for second workpiece 112, robotic device 178, and human operator 180 shown in block form in FIG. 1, respectively.

In this illustrative example, first workpiece 202 has upper portion 210 and lower portion 212. Upper portion 210 and lower portion 212 are examples of physical implementations for first portion 121 and second portion 123, respectively, of first workpiece 108 shown in block form in FIG. 1. Upper portion 210 and lower portion 212 overlap to form lap joint 214 in this illustrative example. Upper portion 210 and lower portion 212 may be physical implementations for skin panels 113 that form skin 117 shown in block form in FIG. 1.

Lap joint 214 may be an example of one physical implementation for joint 125 shown in block form in FIG. 1. Lap joint 214 may be formed longitudinally along first workpiece 202 and second workpiece 204 in this illustrative example.

As depicted, first workpiece 202 and second workpiece 204 may be attached to one another using electromagnetic tool 218 and positioning system 216. Electromagnetic tool 218 may be arranged on end effector 220 of arm 222 of robotic device 206 in this illustrative example. Electromagnetic tool 218 on end effector 220 of arm 222 may be one example of electromagnetic tool 118 on end effector 184 of arm 182 of robotic device 178, while positioning system 216 may be an example of a physical implementation for positioning system 102 shown in block form in FIG. 1.

In this illustrative example, human operator 208 may position positioning system 216 relative to second workpiece 204. For instance, human operator 208 may engage positioning system 216 with second workpiece 204. Positioning system 216 may be configured to stabilize itself relative to first workpiece 202 as electromagnetic tool 218 performs number of operations 114 on at least one of first workpiece 202 or second workpiece 204.

After a number of operations is performed, human operator 208 may remove positioning system 216 from second workpiece 204. In this illustrative example, human operator 208 may disengage positioning system 216 from second workpiece 204.

Figure 3:
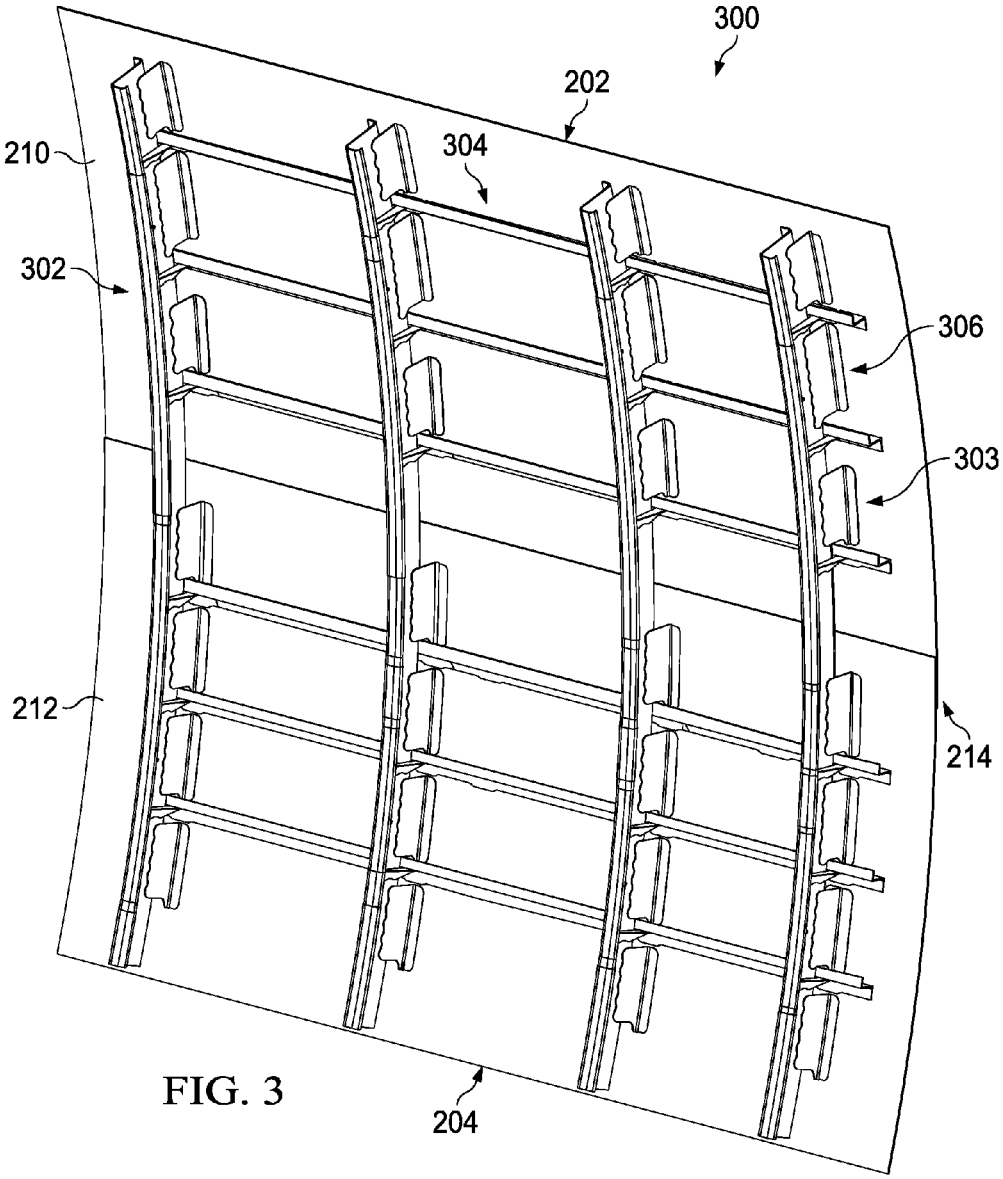
FIG. 3 is an illustration of a first workpiece and a second workpiece in accordance with an illustrative embodiment.

With reference next to FIG. 3, an illustration of first workpiece 202 and second workpiece 204 from FIG. 2 is depicted in accordance with an illustrative embodiment. In this illustrative example, a more detailed view of first workpiece 202 and second workpiece 204 is shown.

As depicted, second workpiece 204 may be comprised of number of structures 300. Number of structures 300 may be an example of one physical implementation for number of structures 156 shown in block form in FIG. 1.

In this illustrative example, number of structures 300 may include plurality of frames 302, group of stringers 304, and number of shear ties 306. Plurality of frames 302, group of stringers 304, and number of shear ties 306 may form structural portion 119 of section 116 of fuselage 115 of aircraft 104 from FIG. 1.

As illustrated, plurality of frames 302 may be positioned to run hoop-wise along section 116 of fuselage 115 in FIG. 1. Accordingly, plurality of frames 302 run along inner surface 303 of first workpiece 202, while group of stringers 304 may be positioned longitudinally along inner surface 303 of first workpiece 202 in this illustrative example.

In some illustrative examples, one or more of the stringers in group of stringers 304 and the frames in plurality of frames 302 may be configured to be attached to first workpiece 202. In particular, stringers in group of stringers 304 and the frames in plurality of frames 302 may be configured to be attached to skin 117 of aircraft 104 in FIG. 1 such that aerodynamic loads acting on skin 117 are transferred to second workpiece 204. Plurality of frames 302 and group of stringers 304 may be comprised of a metal, a metal alloy, a composite material, or some combination thereof in these illustrative examples.

In this depicted example, number of shear ties 306 may attach plurality of frames 302 to first workpiece 202. Number of shear ties 306 may be positioned on one or both sides of plurality of frames 302. Number of shear ties 306 also may be comprised of a metal, a metal alloy, a composite material, or some combination thereof. Number of shear ties 306 may be configured to provide additional structural stiffening forces in structural portion 119 of section 116 of fuselage 115 of aircraft 104 in this illustrative example.

As depicted, plurality of frames 302, group of stringers 304, and number of shear ties 306 may be associated with each other and with first workpiece 202 in various ways. For instance, plurality of frames 302 and number of shear ties 306 may be fastened to one another. In other illustrative examples, plurality of frames 302 may be attached to number of shear ties 306 in another manner.

In still other illustrative examples, group of stringers 304 and number of shear ties 306 may be fastened to first workpiece 202 using number of fasteners 120 shown in block form in FIG. 1. In other illustrative examples, group of stringers 304 and number of shear ties 306 may be attached to first workpiece 202 in some other manner, depending on the particular implementation.

Figure 4:
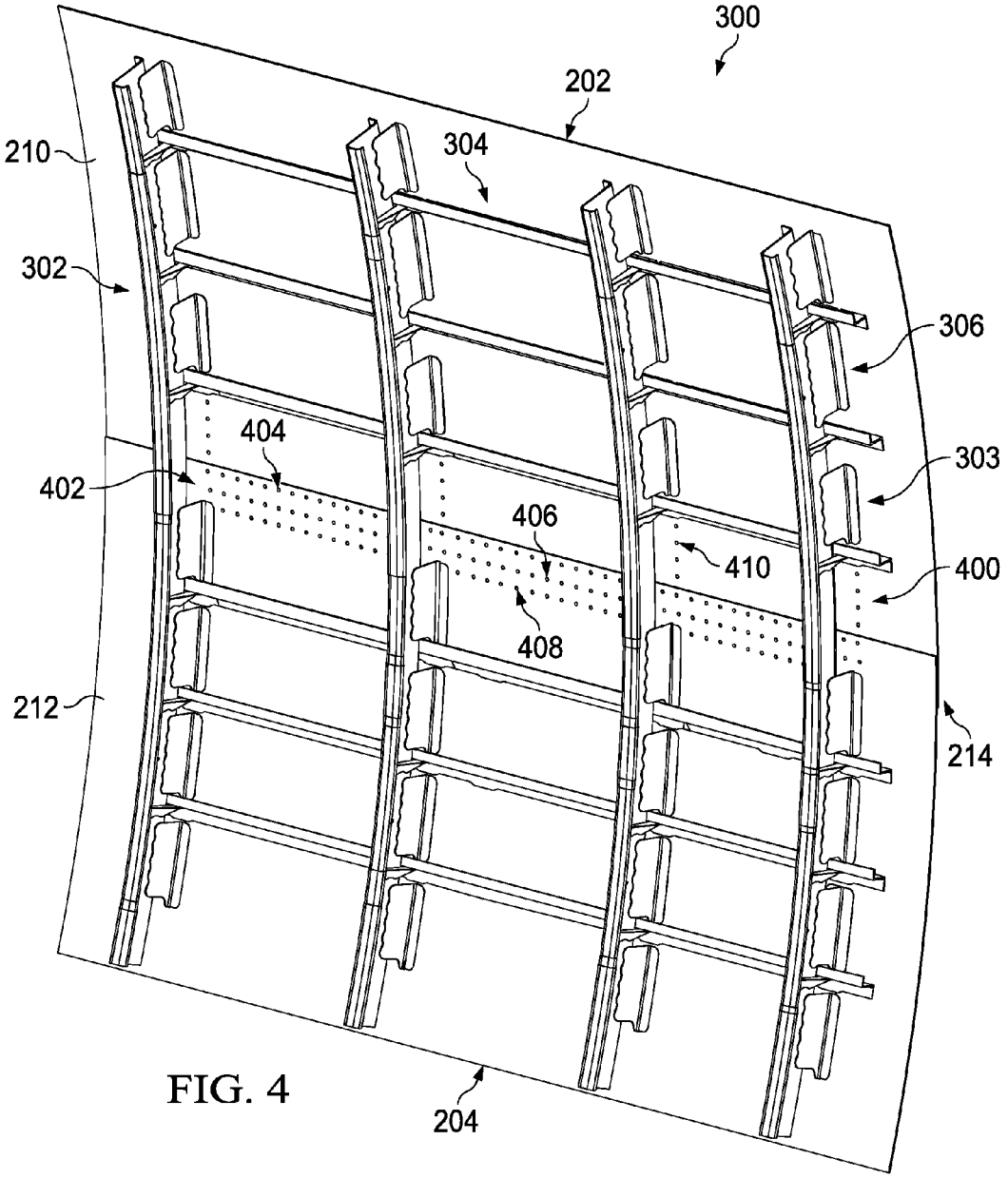
FIG. 4 is an illustration of a first workpiece, a second workpiece, and a number of markings for fasteners in accordance with an illustrative embodiment.

In FIG. 4, an illustration of first workpiece 202 and second workpiece 204 from FIG. 2 and a number of markings for fasteners is depicted in accordance with an illustrative embodiment. In this illustrative example, number of markings 400 may be arranged along first workpiece 202.

Number of markings 400 may indicate where holes 122 shown in block form in FIG. 1 may be drilled in first workpiece 202 in this illustrative example. Number of fasteners 120 may then be installed in holes 122.

As depicted, number of markings 400 may include rows 402. In this illustrative example, three rows 402 may be present in rows 402. In particular, number of markings 400 for upper rivet row 404, middle rivet row 406, and lower rivet row 408 may be present in this illustrative example.

In this illustrative example, number of markings 400 for upper rivet row 404 and lower rivet row 408 may be for upper portion 210 and lower portion 212 of first workpiece 202. In other words, holes 122 may be drilled in upper portion 210 and lower portion 212 and rivets 130 installed in holes 122 to attach upper portion 210 and lower portion 212 of first workpiece 202.

As illustrated, middle rivet row 406 may be for upper portion 210 and lower portion 212 of first workpiece 202, as well as a stringer (not shown). In other words, holes 122 may be drilled in upper portion 210, lower portion 212, and the stringer to attach upper portion 210, lower portion 212 and the stringer at lap joint 214.

In this depicted example, number of markings 400 for vertical rivet rows 410 also may be present in first workpiece 202. Number of markings 400 for vertical rivet rows 410 may be for plurality of frames 302. Although number of markings 400 may be shown in this illustrative example, number of markings 400 is simply shown for understanding and may not actually be present on first workpiece 202.

Figure 5:
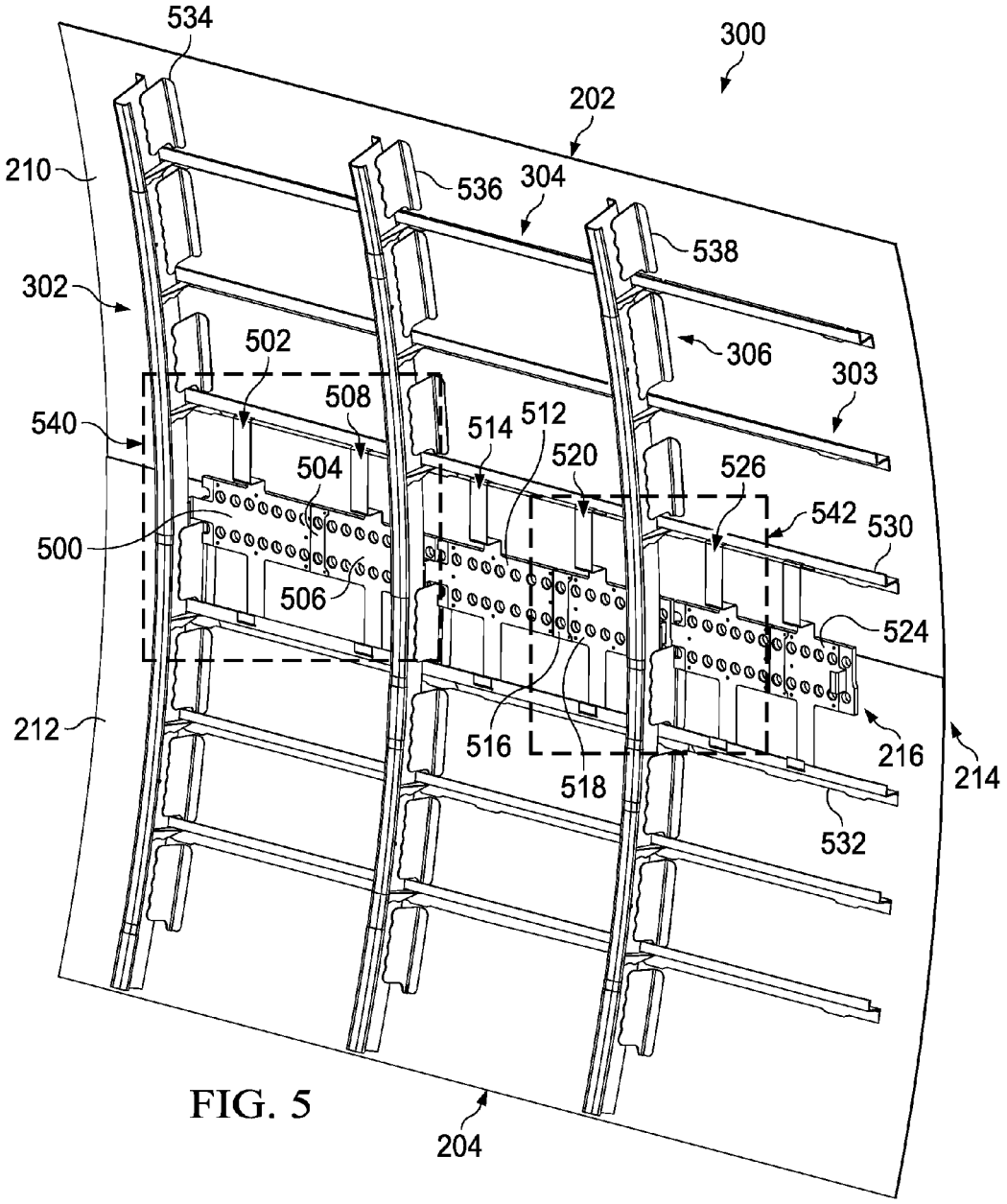
FIG. 5 is an illustration of a positioning system engaged with a second workpiece in accordance with an illustrative embodiment.

With reference to FIG. 5, an illustration of positioning system 216 engaged with second workpiece 204 is depicted in accordance with an illustrative embodiment. In this depicted example, positioning system 216 may include plate 500 associated with biasing system 502, plate 506 associated with biasing system 508, plate 512 associated with biasing system 514, plate 518 associated with biasing system 520, and plate 524 associated with biasing system 526.

As depicted, plate 500, plate 506, plate 512, plate 518, and plate 524 may be examples of physical implementations for plate 134 shown in block form in FIG. 1, while biasing system 502, biasing system 508, biasing system 514, biasing system 520, and biasing system 526 may be examples of physical implementations of biasing system 136 shown in block form in FIG. 1. Interface 504 and interface 516 also may be present in positioning system 216. Interface 504 and interface 516 may be examples of physical implementations for interface 170 shown in block form in FIG. 1.

In this illustrative example, interface 504 may engage plate 500 with plate 506 and interface 516 may engage plate 512 with plate 518. As depicted, positioning system 216 may engage number of structures 300. In particular, positioning system 216 may engage stringer 530, stringer 532, frame 534, frame 536, and frame 538 in these illustrative examples. Positioning system 216 may engage number of structures 300 to hold one or more of plate 500, plate 506, plate 512, plate 518, and plate 524 in desired position 110 shown in block form in FIG. 1 relative to first workpiece 202 in these illustrative examples.

Figure 8:
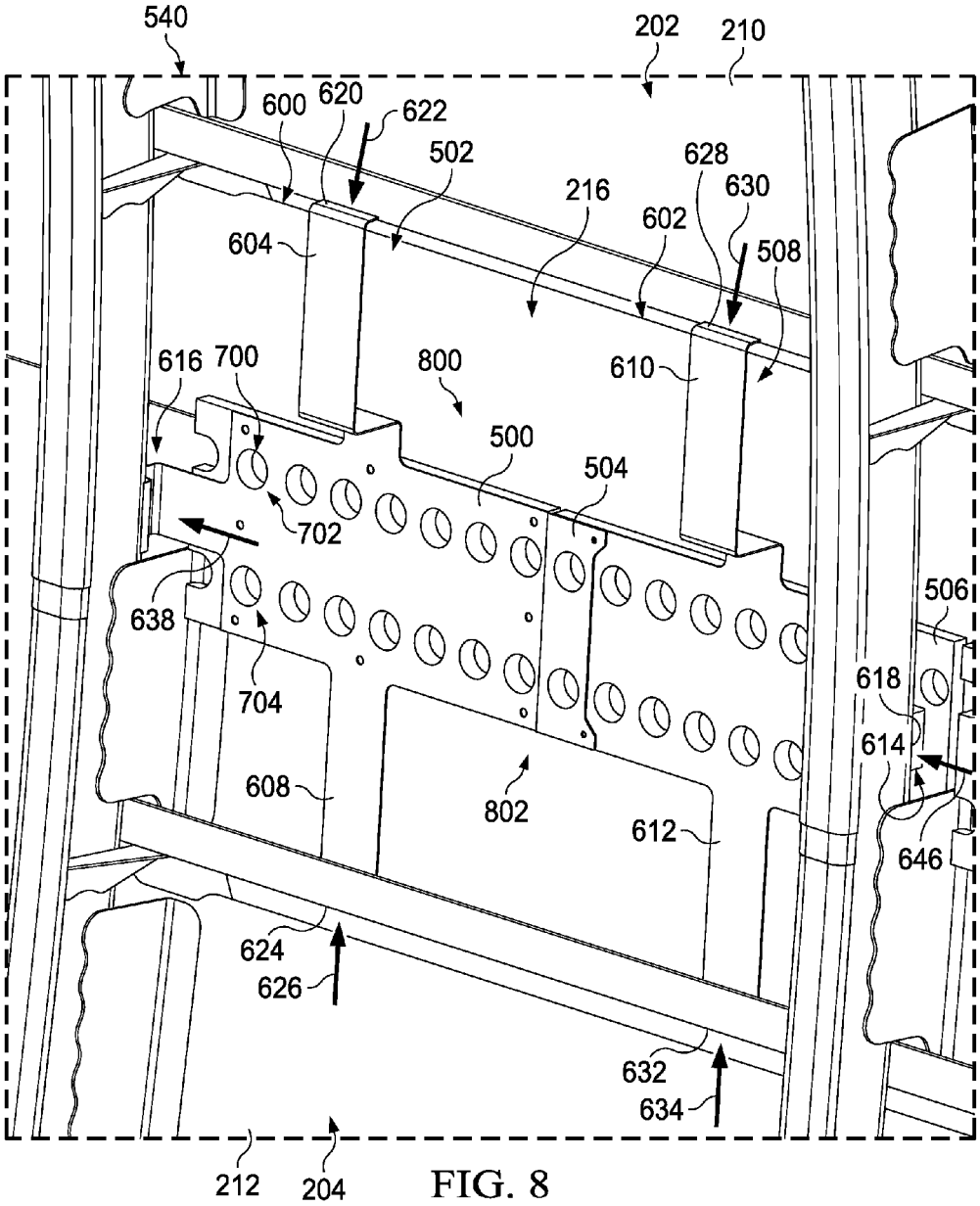
FIG. 8 is a more detailed illustration of a section of a positioning system engaged in a second workpiece in accordance with an illustrative embodiment.
Figure 9:
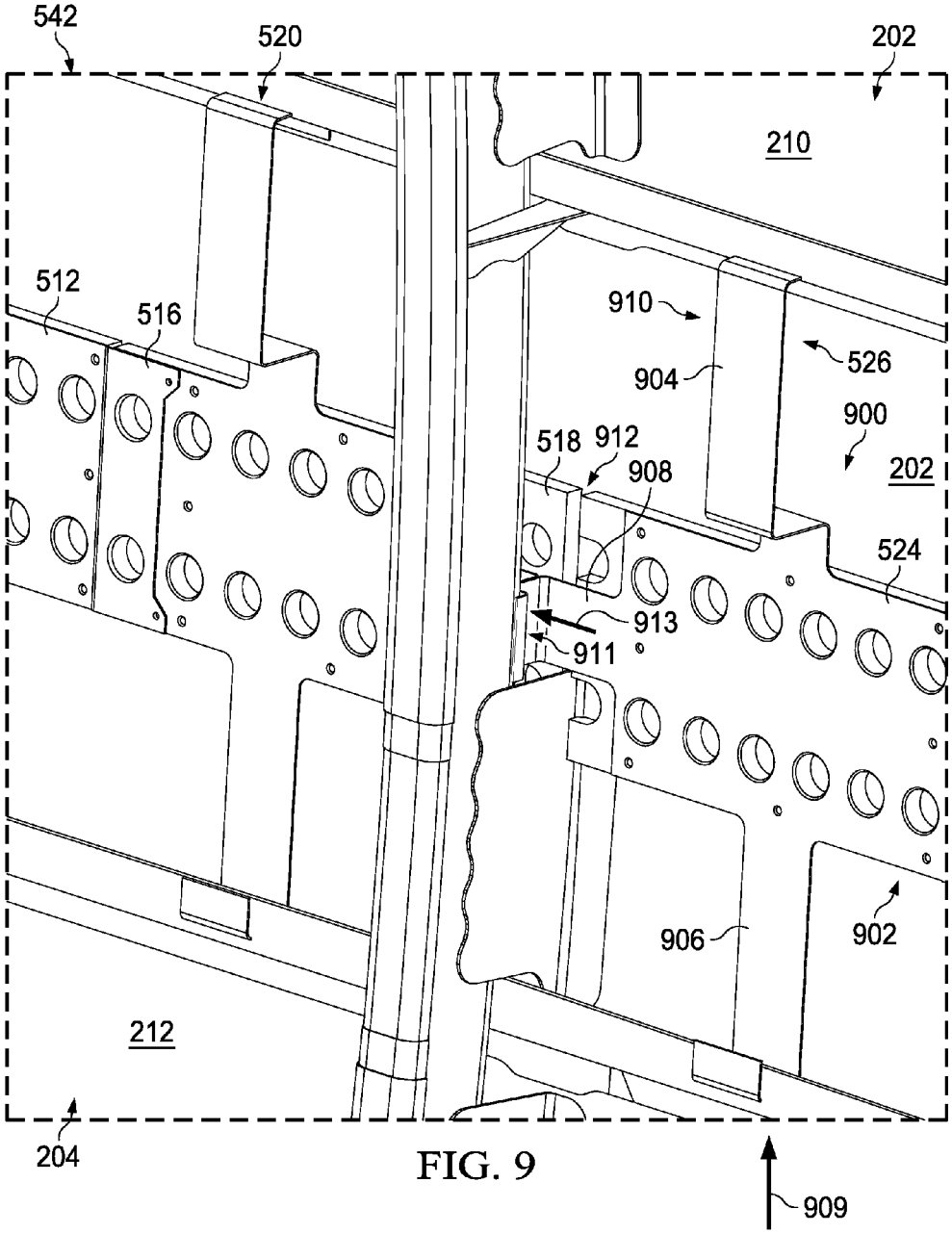
FIG. 9 is an illustration of a section of a positioning system engaged with a second workpiece in accordance with an illustrative embodiment.

A more detailed illustration of section 540 is shown and described in more detail in FIG. 8, while a more detailed illustration of section 542 is shown and described in more detail in FIG. 9.

Figure 6:
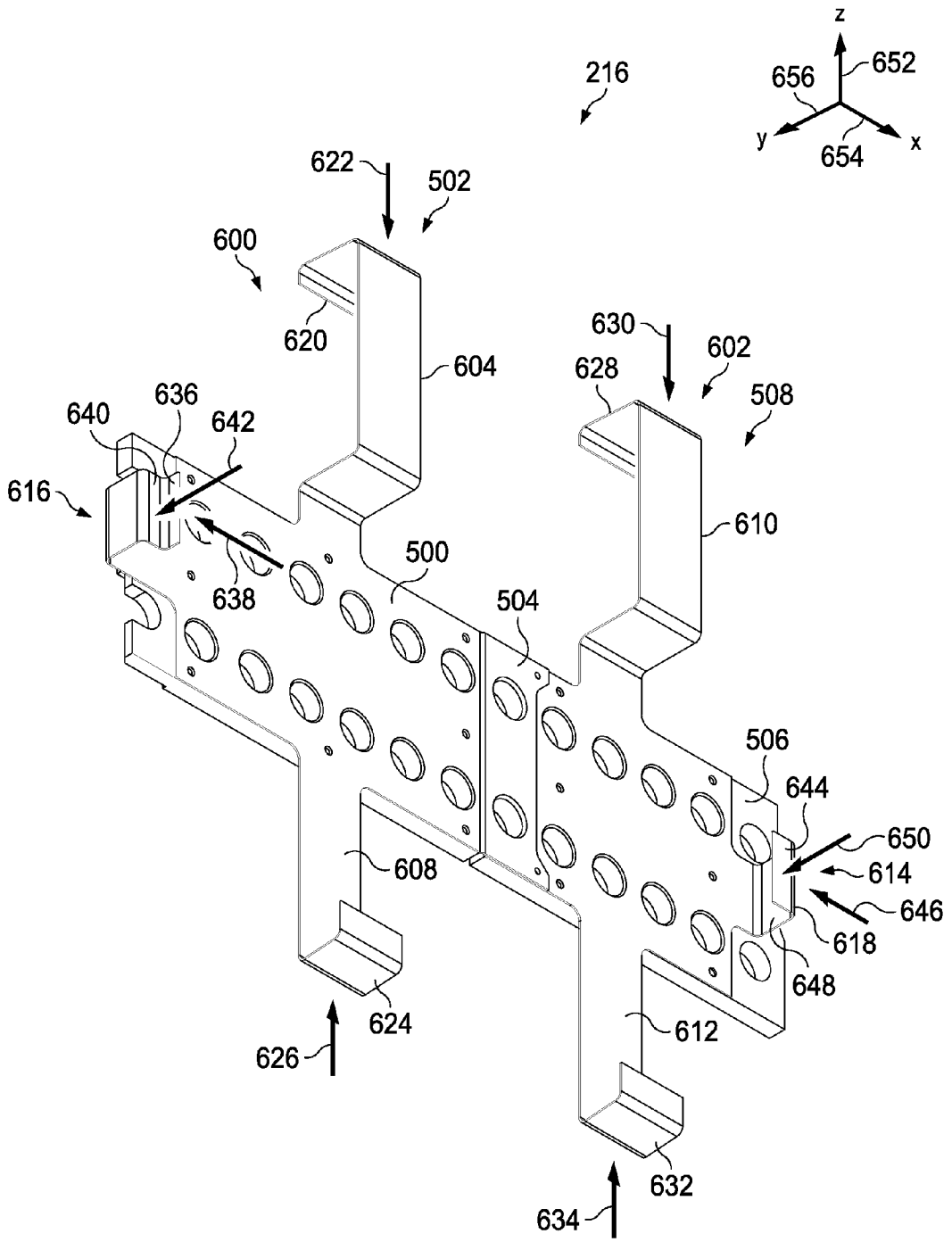
FIG. 6 is an illustration of a perspective front view of a plate with a biasing system and another plate with a biasing system in a positioning system in accordance with an illustrative embodiment.

Turning next to FIG. 6, an illustration of a perspective front view of plate 500 with biasing system 502 and plate 506 with biasing system 508 in positioning system 216 from FIG. 5 is depicted in accordance with an illustrative embodiment. In this illustrative example, biasing system 502 may include pair of springs 600, while biasing system 508 may include pair of springs 602. Pair of springs 600 and pair of springs 602 may be examples of physical implementations for pair of springs 144 shown in block form in FIG. 1.

As depicted, pair of springs 600 may have spring 604 and spring 608 positioned opposite each other along plate 500. In a similar fashion, pair of springs 602 may have spring 610 and spring 612 positioned opposite each other along plate 506.

Pair of springs 614 also may be seen in this view. Pair of springs 614 may be yet another example of one physical implementation for pair of springs 144 in FIG. 1. Pair of springs 614 may include spring 616 and spring 618 positioned opposite each other along plate 500 and plate 506, respectively.

In this illustrative example, pair of springs 600, pair of springs 602, and pair of springs 614 may be configured to stabilize plate 500 and plate 506 in respective direction 146 shown in block form in FIG. 1. In particular, pair of springs 600, pair of springs 602, and pair of springs 614 may be configured to engage with number of structures 300 in FIG. 3 to stabilize plate 500 and plate 506. In other words, plate 500 with biasing system 502 and plate 506 with biasing system 508 are configured to snap-fit into place with respect to number of structures 300.

Force 139 shown in block form in FIG. 1 may be applied to at least one of pair of springs 600, pair of springs 602, or pair of springs 614 by number of structures 300 to engage number of structures 300 in these illustrative examples. Pair of springs 600, pair of springs 602, and pair of springs 614 apply reactive force 141 (not shown in this view) back against number of structures 300 to stabilize plate 500 and plate 506. In these illustrative examples, reactive force 141 may be opposite to force 139.

As depicted, spring 604 and spring 610 may be configured to engage stringer 530, while spring 608 and spring 612 may be configured to engage stringer 532 in second workpiece 204 shown in FIG. 5. In a similar fashion, spring 616 and spring 618 may be configured to engage frame 534 and frame 536, respectively, shown in FIG. 5.

In this illustrative example, force 622 may be applied to flange 620 of spring 604 by stringer 530. Force 626 may be applied to flange 624 of spring 608 by stringer 532. Similarly, force 630 may be applied against flange 628 of spring 610 by stringer 530, while force 634 may be applied against flange 632 of spring 612 by stringer 532.

As depicted, force 638 may be applied to flange 636 of spring 616 by frame 534. Force 642 may be applied to flange 640 of spring 616 by frame 534. Force 646 may be applied to flange 644 of spring 618 by frame 536, while force 650 may be applied to flange 648 of spring 618 by frame 536.

In this illustrative example, force 622, force 626, force 630, and force 634 may be applied in z-direction 652. Force 638 and force 646 may be applied in x-direction 654, while force 642 and force 650 may be applied in y-direction 656. Pair of springs 600, pair of springs 602, and pair of springs 614 apply a responsive force to stabilize plate 500 and plate 506 in x-direction 654, y-direction 656, and z-direction 652 in these illustrative examples.

Figure 7:
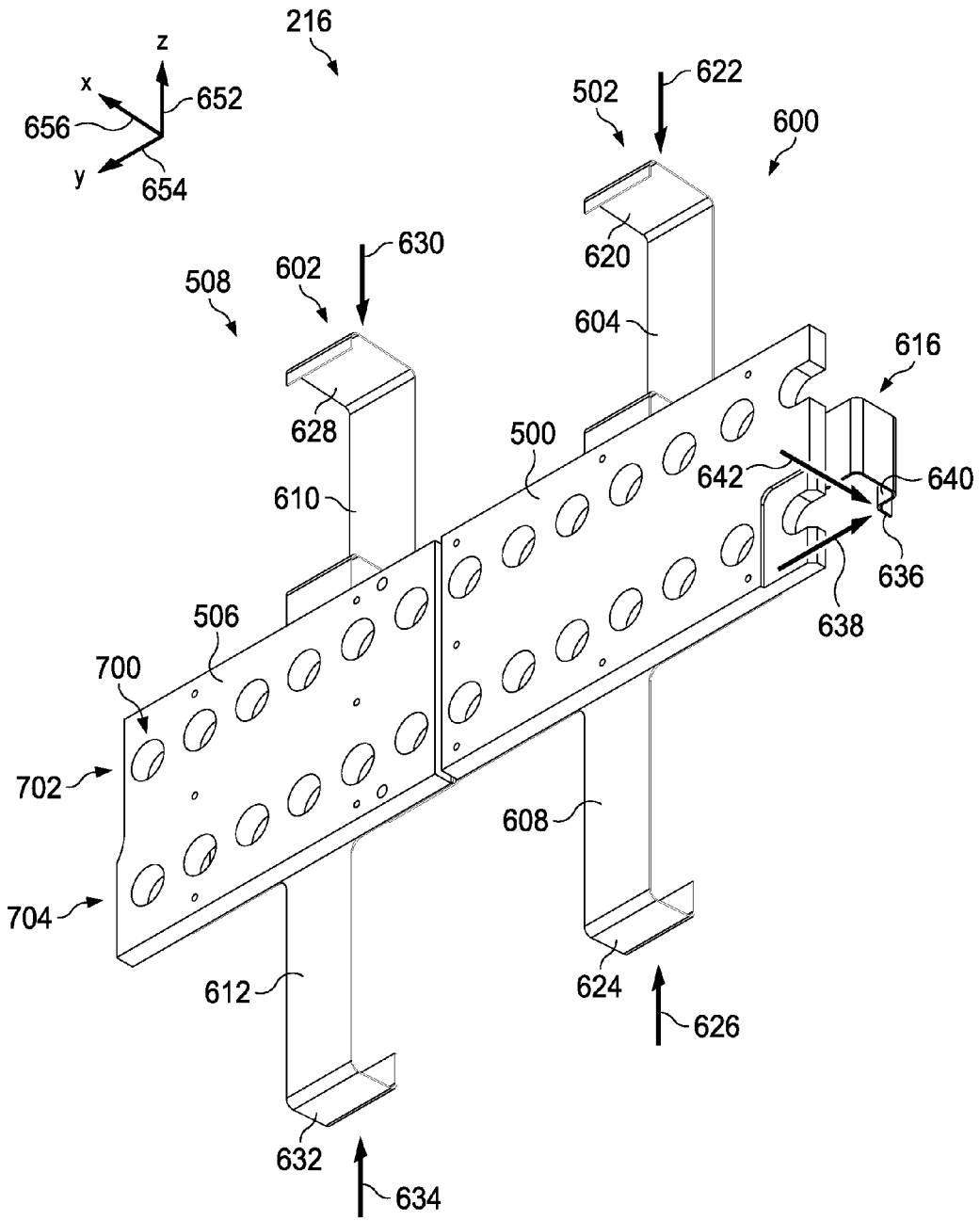
FIG. 7 is an illustration of a perspective rear view of a plate with a biasing system and another plate with a biasing system in a positioning system in accordance with an illustrative embodiment.

With reference to FIG. 7, an illustration of a perspective rear view of plate 500 with biasing system 502 and plate 506 with biasing system 508 in positioning system 216 from FIG. 6 is depicted in accordance with an illustrative embodiment. In this depicted example, plate 500 and plate 506 may have plurality of openings 700. Plurality of openings 700 may be one example for plurality of openings 164 shown in block form in FIG. 1.

As illustrated, plurality of openings 700 may have row 702 and row 704. Row 702 may correspond to upper rivet row 404 and row 704 may correspond to lower rivet row 408 shown in number of markings 400 in FIG. 4. In other words, electromagnetic tool 218 in FIG. 2 may use row 702 and row 704 of plurality of openings 700 in plate 500 and plate 506 to form upper rivet row 404 and lower rivet row 408 in these illustrative examples.

In FIG. 8, a more detailed illustration of section 540 of positioning system 216 from FIG. 5 engaged with second workpiece 204 is depicted in accordance with an illustrative embodiment. As depicted, an illustration of plate 500 with biasing system 502 and plate 506 with biasing system 508 engaged with second workpiece 204 is shown in this view. Biasing system 502 and biasing system 508 may hold plate 500 and plate 506, respectively, in desired position 800 relative to first workpiece 202 in this illustrative example.

In this depicted example, biasing system 502 and biasing system 508 may be engaged with second workpiece 204 in bay 802. In other words, biasing system 502 and biasing system 508 are configured to snap-fit into place with respect to second workpiece 204 to stabilize plate 500 and plate 506, respectively.

Bay 802 may be a space within second workpiece 204 relative to first workpiece 202. Stringer 530, stringer 532, frame 534, and frame 536 in FIG. 5 may form bay 802 in this illustrative example.

Turning next to FIG. 9, an illustration of section 542 of positioning system 216 engaged with second workpiece 204 is depicted in accordance with an illustrative embodiment. In this depicted example, plate 518 with biasing system 520 and plate 524 with biasing system 526 from FIG. 5 engaged with second workpiece 204 is shown in this view. Biasing system 526 may hold plate 524 in desired position 900 relative to first workpiece 202 in this illustrative example.

In this depicted example, biasing system 526 may be engaged with second workpiece 204 in bay 902. Stringer 530, stringer 532, and frame 538 may form bay 902 in this illustrative example.

As illustrated, biasing system 526 may include spring 904, spring 906, and spring 908 arranged along plate 524. Spring 904 and spring 906 stabilize plate 524 in z-direction 909, while spring 908 and another spring (not shown in this view) stabilize plate 524 in x-direction 911 and y-direction 913.

Spring 904 and spring 906 may comprise pair of springs 910 in this illustrative example. Pair of springs 910 may be yet another example of a physical implementation for pair of springs 144 shown in block form in FIG. 1.

In this illustrative example, plate 518 and plate 524 may not contact each other. Instead, gap 912 may be present between plate 518 and plate 524. Gap 912 may be configured to maintain a desired amount of space between plate 518 and plate 524 such that electromagnetic tool 218 from FIG. 2 may perform number of operations 114. In other illustrative examples, plate 518 and plate 524 may contact one another.

Figure 10:
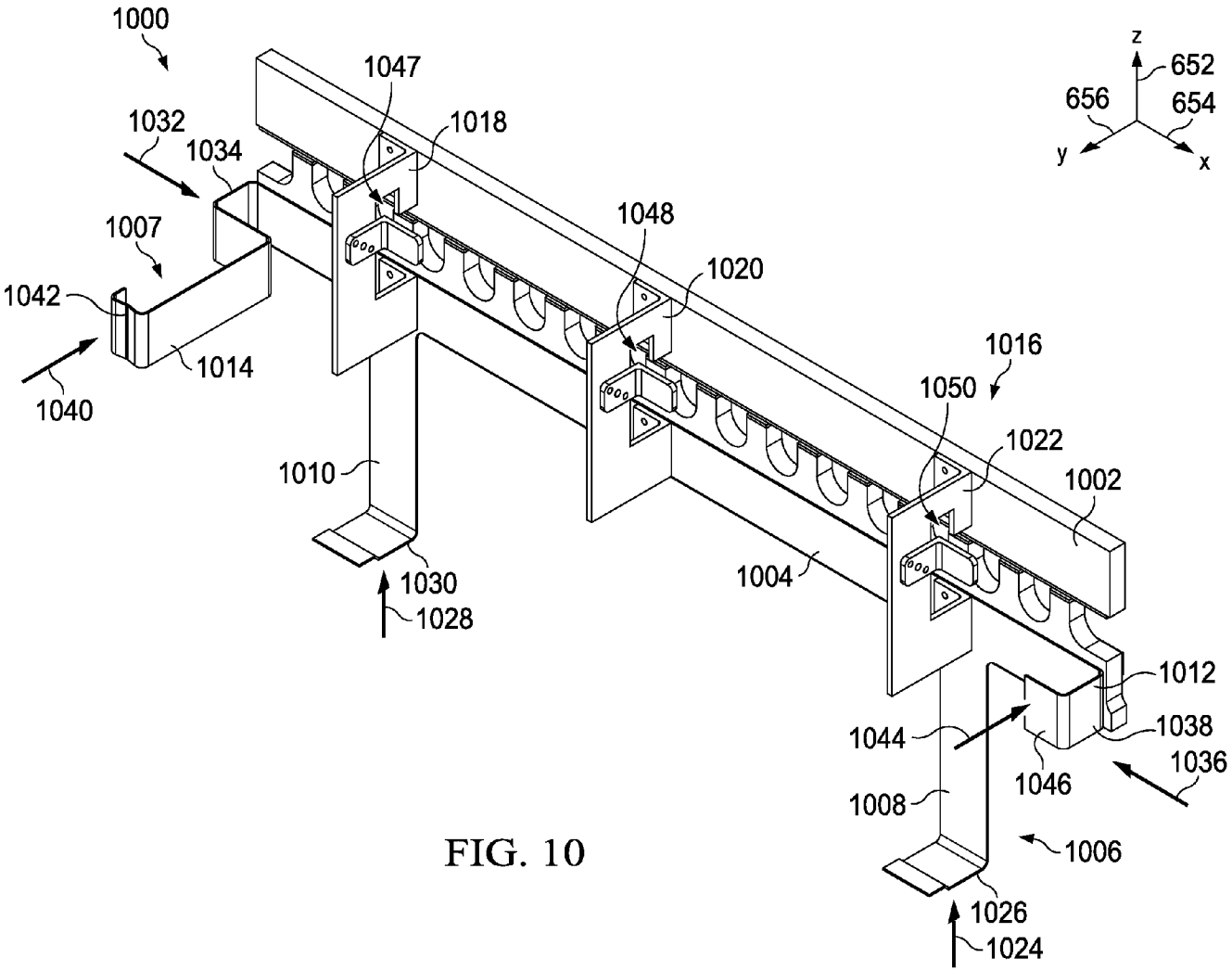
FIG. 10 is an illustration of a perspective front view of a positioning system in accordance with an illustrative embodiment.

With reference to FIG. 10, an illustration of a perspective front view of a positioning system is depicted in accordance with an illustrative embodiment. In this depicted example, positioning system 1000 may include plate 1002, plate 1004, and biasing system 1006. Positioning system 1000 with plate 1002, plate 1004, and biasing system 1006 may be one example of positioning system 102 with first plate 166, second plate 168, and biasing system 136 shown in block form in FIG. 1.

As depicted, biasing system 1006 may include number of springs 1007. Number of springs 1007 may be an example of one physical implementation for number of springs 140 shown in block form in FIG. 1. Number of springs 1007 may be configured to hold plate 1002 and plate 1004 relative to first workpiece 202 in FIG. 2.

In this depicted example, number of springs 1007 may include spring 1008, spring 1010, spring 1012, and spring 1014. Spring 1008 and spring 1010 may be configured to engage with stringer 532 in second workpiece 204, while spring 1012 and spring 1014 may be configured to engage with frame 534 and frame 536, respectively, in second workpiece 204 in FIG. 5.

As illustrated, group of connecting brackets 1016 may be coupled to plate 1002 and plate 1004. Group of connecting brackets 1016 may be an example of one physical implementation for group of connecting brackets 172 shown in block form in FIG. 1. Group of connecting brackets 1016 may be configured to stabilize plate 1002 relative to at least one of first workpiece 202 shown in FIGS. 2-5 or plate 1004.

In this illustrative example, group of connecting brackets 1016 may be attached to plate 1002 and plate 1004 using at least one of screws, clips, an adhesive, or some other suitable type of attachment. Group of connecting brackets 1016 may include connecting bracket 1018, connecting bracket 1020, and connecting bracket 1022 spaced along plate 1002 and plate 1004.

As depicted, when biasing system 1006 is engaged with second workpiece 204, force 139 from FIG. 1 may be applied to biasing system 1006 by number of structures 300 in second workpiece 204 shown in FIG. 3. Biasing system 1006 may apply reactive force 141 to number of structures 300. In these illustrative examples, reactive force 141 (not shown in this view) may be opposite to force 139.

In this illustrative example, stringer 532 may apply force 1024 to flange 1026 of spring 1008 and force 1028 to flange 1030 of spring 1010. In a similar fashion, frame 534 may apply force 1032 to flange 1034 and force 1040 to flange 1042 of spring 1012, while frame 536 may apply force 1036 to flange 1038 and force 1044 to flange 1046 of spring 1008.

In this illustrative example, force 1024 and force 1028 may be in z-direction 652. Additionally, force 1032 and force 1036 may be in x-direction 654, while force 1040 and force 1044 may be in y-direction 656 in this illustrative example. Spring 1008, spring 1010, spring 1012, and spring 1014 apply an opposing force to number of structures 300 in second workpiece 204 to stabilize positioning system 1000 relative to first workpiece 202 in x-direction 654, y-direction 656, and z-direction 652.

Positioning system 1000 may be configured for use when attaching a stringer (not shown in this view) to first workpiece 202. Gap 1047 formed by connecting bracket 1018, gap 1048 formed by connecting bracket 1020, and gap 1050 formed by connecting bracket 1022 may be configured to accommodate the stringer as electromagnetic tool 218 attaches the stringer to first workpiece 202 in this illustrative example.

As illustrated, positioning system 1000 may be used after forming upper rivet row 404 and lower rivet row 408 in first workpiece 202 using electromagnetic tool 218. In this instance, positioning system 216 may be removed and replaced by positioning system 1000. Electromagnetic tool 218 may then continue number of operations 114.

Figure 11:
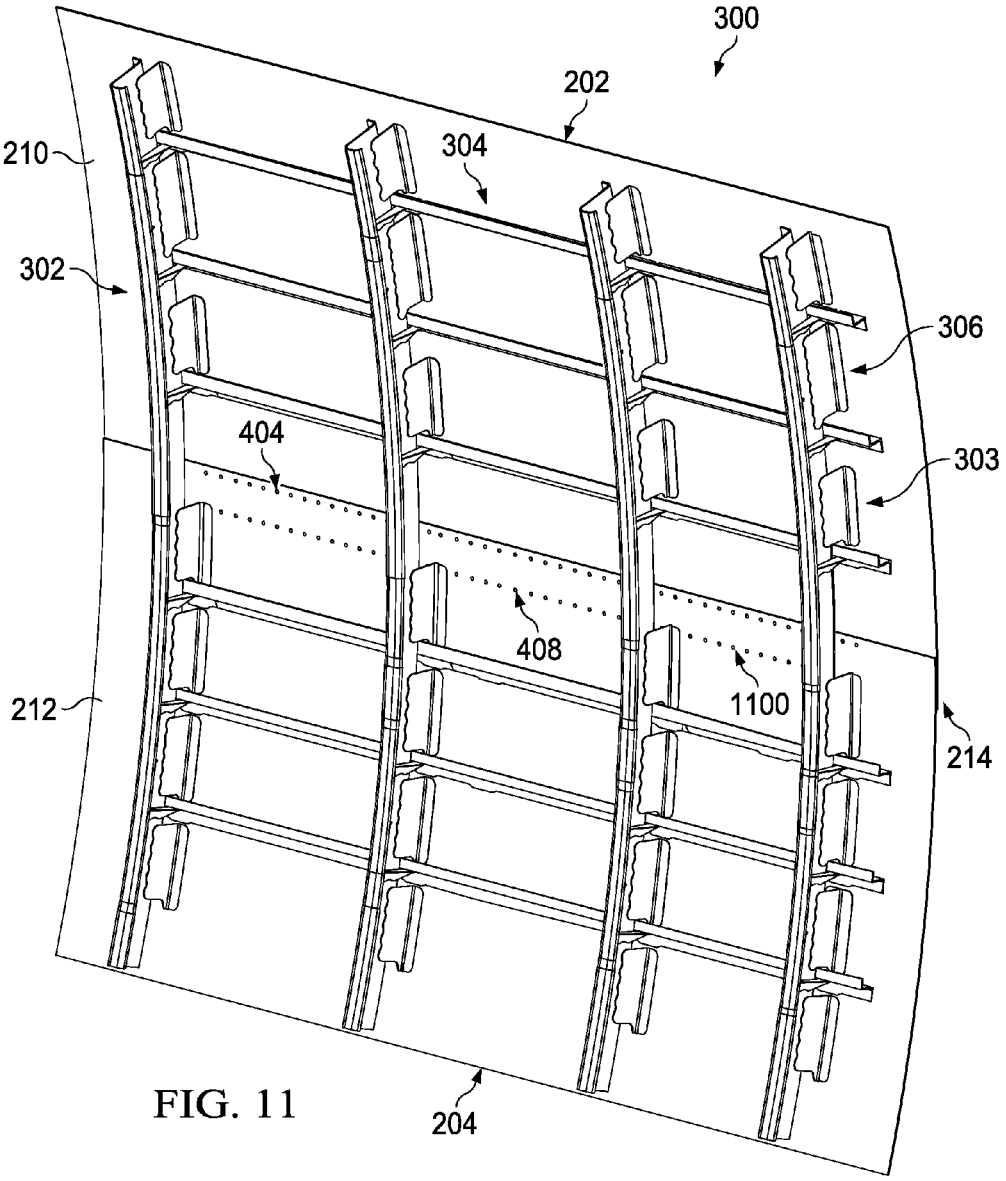
FIG. 11 is an illustration of rivets installed in a first workpiece and a second workpiece in accordance with an illustrative embodiment.

In FIG. 11, an illustration of rivets installed in first workpiece 202 and second workpiece 204 from FIG. 2 is depicted in accordance with an illustrative embodiment. In this depicted example, rivets 1100 may have been installed in upper portion 210 and lower portion 212 of first workpiece 202. In this illustrative example, positioning system 216 has been removed from second workpiece 204.

Figure 12:
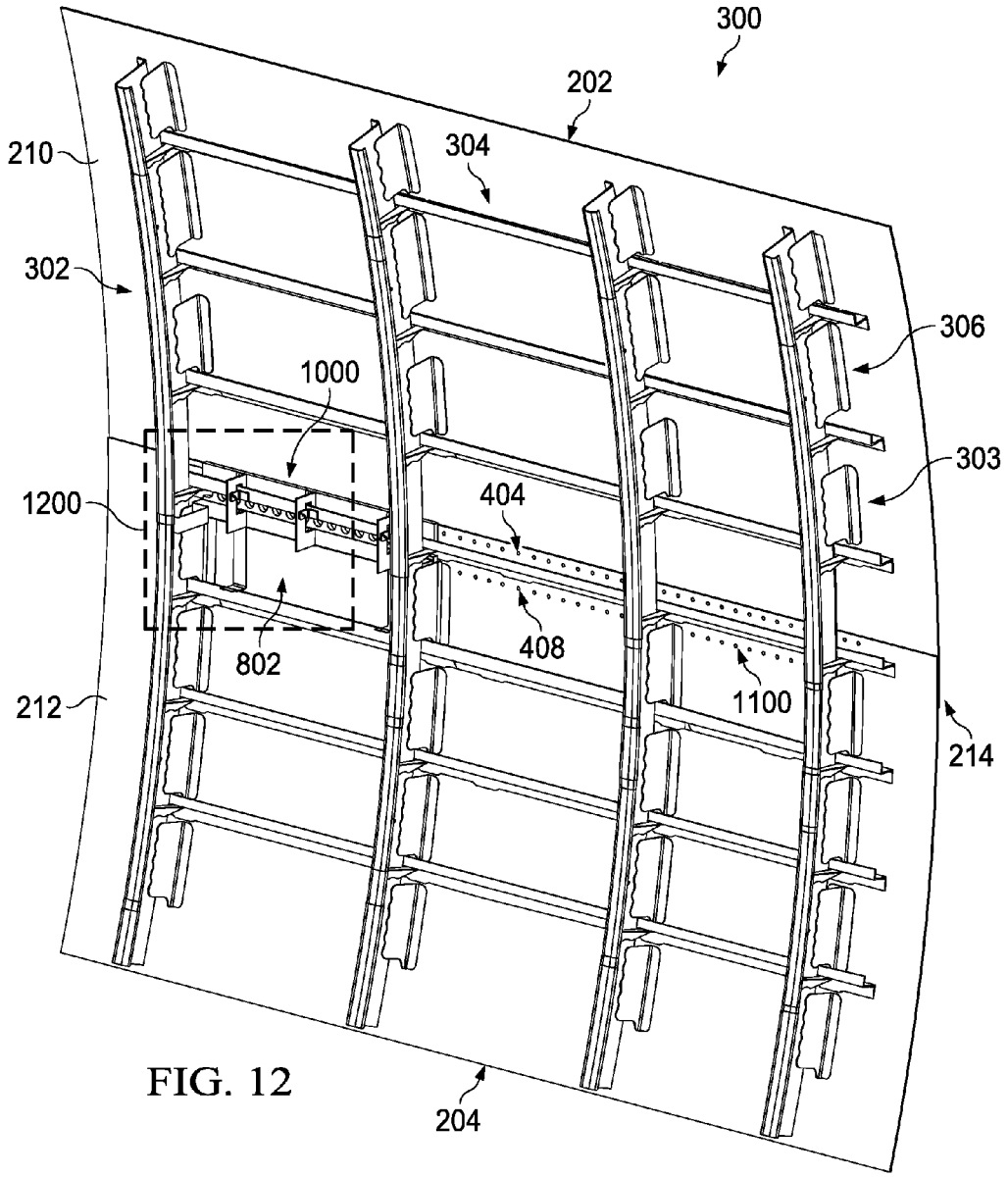
FIG. 12 is an illustration of a positioning system engaged with a second workpiece in accordance with an illustrative embodiment.

Referring next to FIG. 12, an illustration of positioning system 1000 from FIG. 10 engaged with second workpiece 204 in FIG. 2 is depicted in accordance with an illustrative embodiment. In this depicted example, positioning system 1000 may be engaged with second workpiece 204 in bay 802. A more detailed view of section 1200 of positioning system 1000 in bay 802 may be shown and described in FIG. 13.

Figure 13:
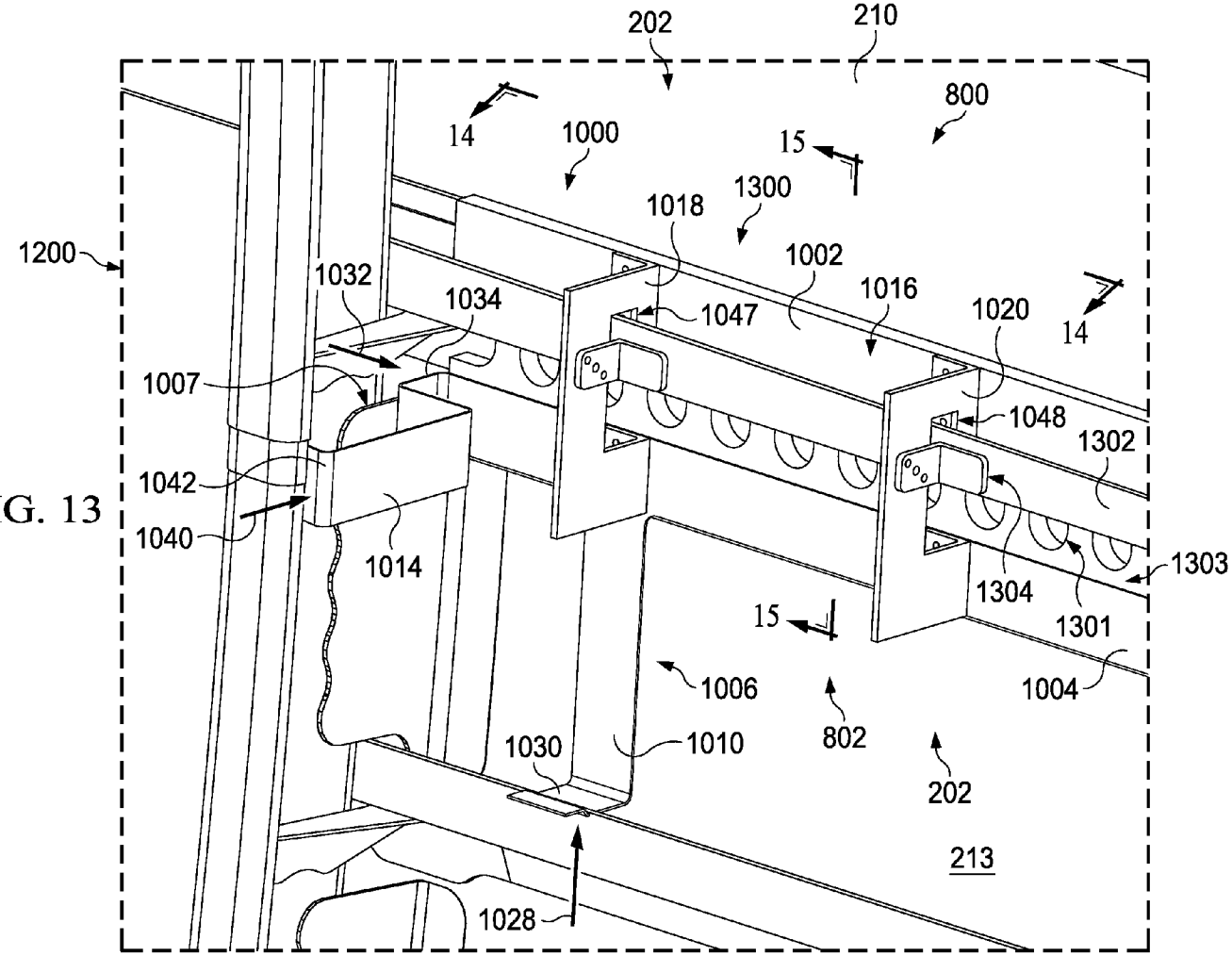
FIG. 13 is an illustration of a positioning system engaged with a second workpiece in accordance with an illustrative embodiment.

Turning next to FIG. 13, an illustration of positioning system 1000 from FIG. 10 engaged with second workpiece 204 is depicted in accordance with an illustrative embodiment. In this depicted example, biasing system 1006 may hold plate 1002 and plate 1004 in desired position 1300. Desired position 1300 may be another example of desired position 110 shown in block form in FIG. 1. Positioning system 1000 may be installed in bay 802 in this illustrative example.

In this depicted example, plate 1002 and plate 1004 may have plurality of openings 1301. Plurality of openings 1301 may be yet another example of a physical implementation for plurality of openings 164 shown in block form in FIG. 1.

As depicted, plurality of openings 1301 may be arranged in row 1303. Row 1303 may correspond to middle rivet row 406 in number of markings 400 shown in FIG. 4. In other words, electromagnetic tool 218 in FIG. 2 may use row 1303 of plurality of openings 1301 formed by plate 1002 and plate 1004 to form middle rivet row 406 in these illustrative examples.

As depicted, stringer 1302 may be positioned within gap 1047, gap 1048, and gap 1050 (not shown in this view) of group of connecting brackets 1016. Stringer 1302 may be secured to group of connecting brackets 1016 using number of stringer brackets 1304 in this illustrative example. Stringer 1302 may be placed relative to positioning system 1000 before group of connecting brackets 1016 are attached to plate 1002 and plate 1004. Once group of connecting brackets 1016 are attached to plate 1002, plate 1004, and stringer 1302, electromagnetic tool 218 from FIG. 2 may install middle rivet row 406 in this illustrative example.

Figure 14:
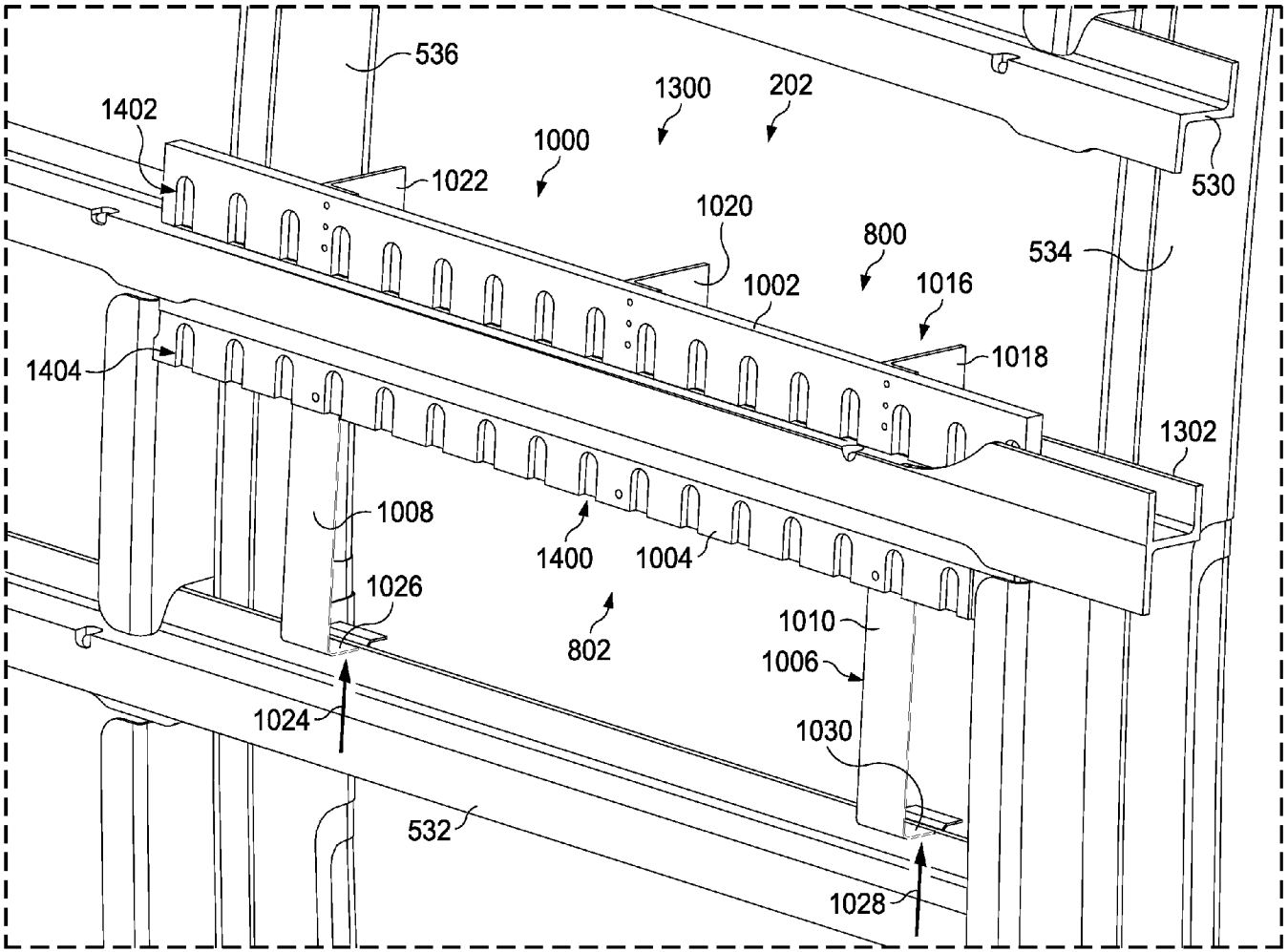
FIG. 14 is an illustration of a rear view of a positioning system engaged with a second workpiece in accordance with an illustrative embodiment.

With reference now to FIG. 14, an illustration of a rear view of positioning system 1000 engaged with second workpiece 204 from FIG. 13 is depicted in accordance with an illustrative embodiment. In this depicted example, positioning system 1000 is shown in the direction of view lines 14-14 in FIG. 13. First workpiece 202 may not be seen in this view.

As depicted, plate 1002 and plate 1004 may have number of cutouts 1400. In particular, plate 1002 may have row 1402 of number of cutouts 1400, while plate 1004 may have row 1404 of number of cutouts 1400. Row 1402 and row 1404 may be configured to receive rivets 1100 shown in FIG. 11.

For example, without limitation, row 1402 may receive upper rivet row 404 and row 1404 may receive lower rivet row 408 of rivets 1100 in FIG. 11. In this manner, positioning system 1000 may be placed relative to first workpiece 202 such that rivets 1100 are positioned in number of cutouts 1400.

Figure 15:
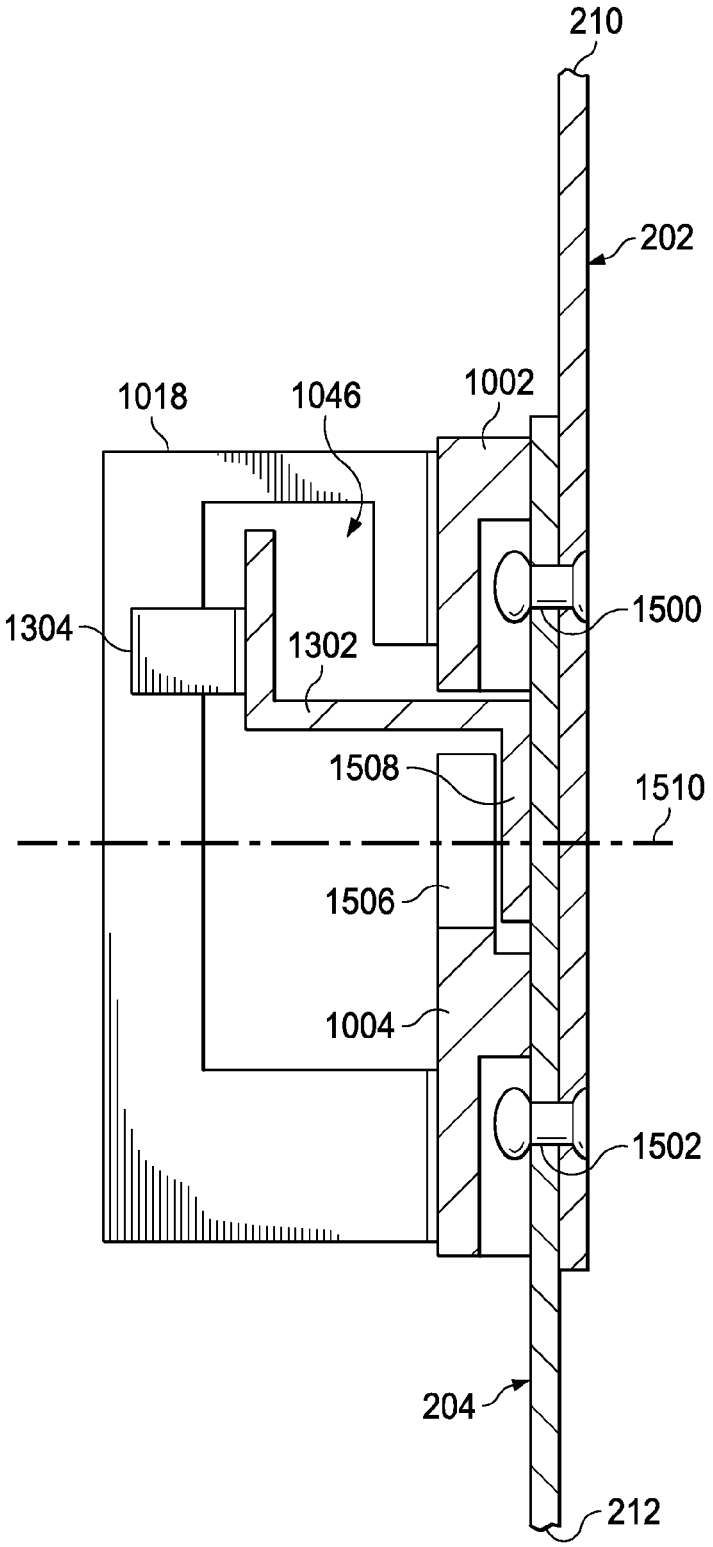
FIG. 15 is an illustration of a cross-sectional view of a positioning system engaged with a second workpiece in accordance with an illustrative embodiment.

In FIG. 15, an illustration of a cross-sectional view of positioning system 1000 engaged with second workpiece 204 taken along lines 15-15 in FIG. 13 is depicted in accordance with an illustrative embodiment. In this depicted example, stringer 1302 may be positioned between plate 1004 and lower portion 212 of first workpiece 202.

As illustrated, rivet 1500 in upper rivet row 404 seen in FIG. 11 and rivet 1502 in lower rivet row 408 seen in FIG. 11 are shown. Rivet 1500 and rivet 1502 may be received by number of cutouts 1400 in FIG. 14 in plate 1002 and plate 1004, respectively. A hole (not shown in this view) may be drilled for a rivet (not shown in this view) using opening 1506 as a guide.

In this depicted example, the rivet may then be installed to attach portion 1508 of stringer 1302 to upper portion 210 and lower portion 212 of first workpiece 202. The hole may be drilled along axis 1510 by electromagnetic tool 218. Axis 1510 may be positioned through the center of opening 1506 in this illustrative example.

Figure 16:
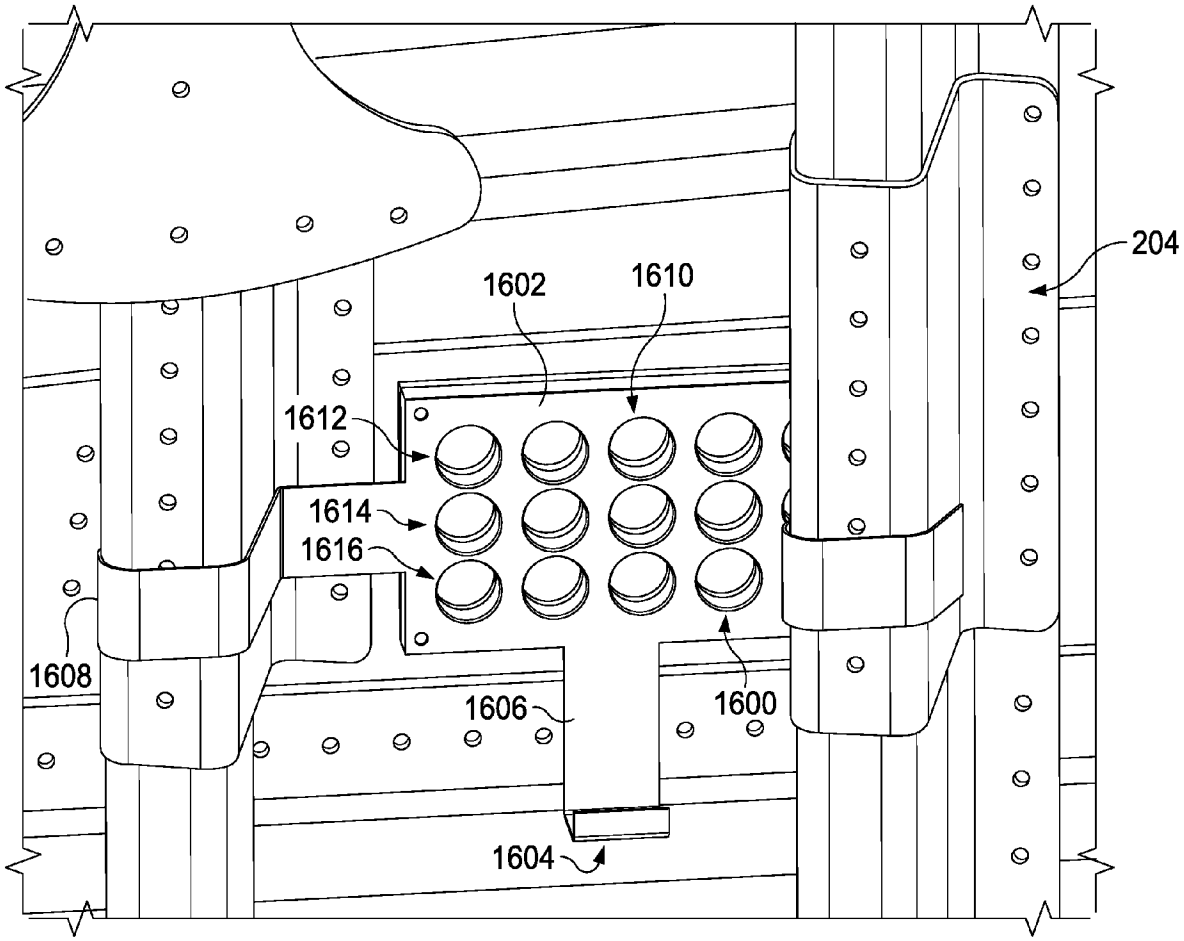
FIG. 16 is an illustration of a positioning system engaged with a second workpiece in accordance with an illustrative embodiment.

Turning next to FIG. 16, an illustration of a positioning system engaged with second workpiece 204 is depicted in accordance with an illustrative embodiment. In this illustrative example, positioning system 1600 may be engaged with second workpiece 204.

As depicted, positioning system 1600 may include plate 1602 and biasing system 1604. Positioning system 1600 with plate 1602 and biasing system 1604 may be an example of a physical implementation for positioning system 102 with plate 134 and biasing system 136 shown in block form in FIG. 1.

In this illustrative example, biasing system 1604 may include spring 1606 and spring 1608. Spring 1606 and spring 1608 may be examples of a physical implementation for number of springs 140 shown in block form in FIG. 1. Spring 1606 and spring 1608 may be configured to engage second workpiece 204, as described above.

As illustrated, plate 1602 may have plurality of openings 1610, which may be an example of one physical implementation for plurality of openings 164 in FIG. 1. In this illustrative example, plurality of openings 1610 may be arranged in row 1612, row 1614, and row 1616. Row 1612, row 1614, and row 1616 may correspond to upper rivet row 404, middle rivet row 406, and lower rivet row 408 shown in FIG. 4. With the use of positioning system 1600, all three rivet rows may be processed without engaging and disengaging additional positioning systems.

Figure 17:
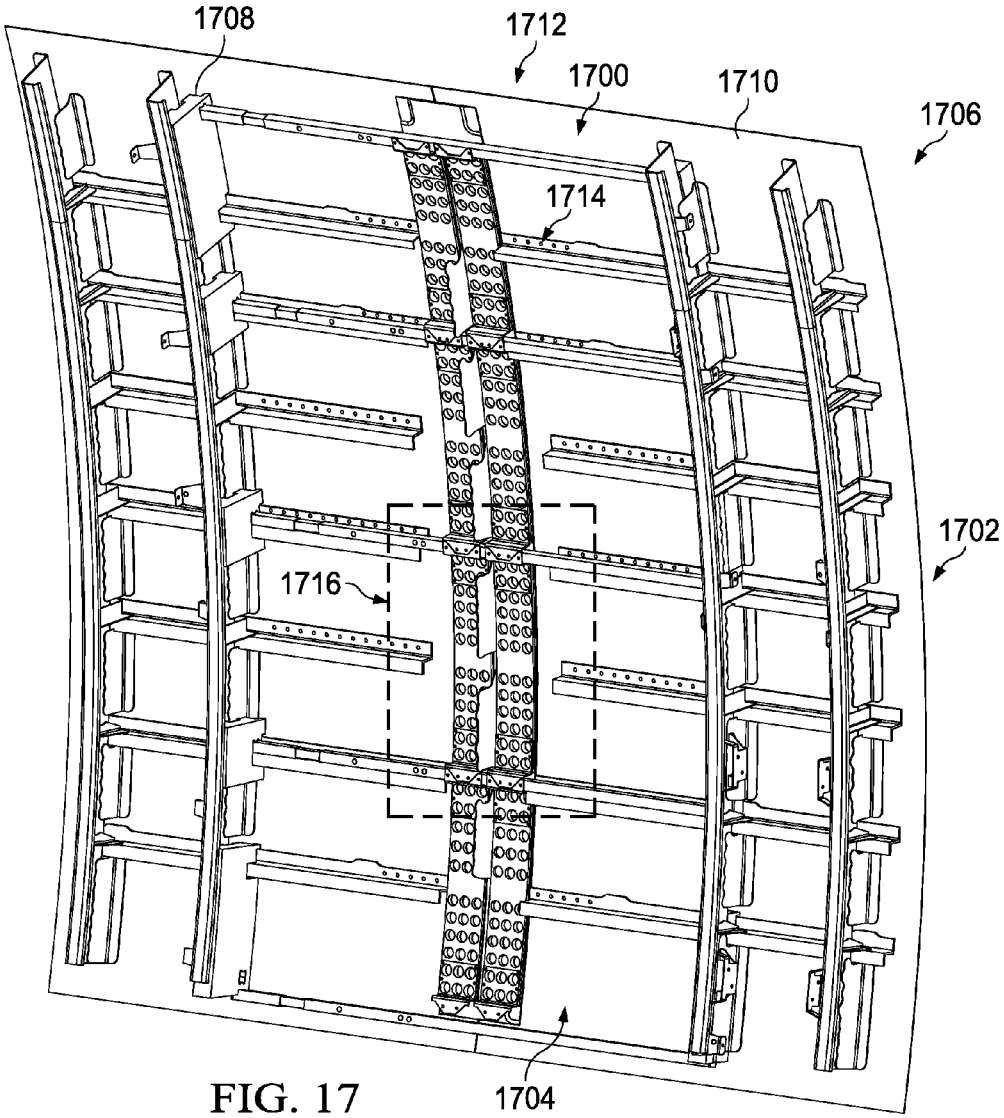
FIG. 17 is an illustration of a positioning system engaged in a second workpiece in accordance with an illustrative embodiment.

With reference next to FIG. 17, an illustration of a positioning system engaged in a second workpiece is depicted in accordance with an illustrative embodiment. In this illustrative example, positioning system 1700 may be engaged in second workpiece 1702 to stabilize a number of plates 1704 relative to first workpiece 1706. Positioning system 1700, second workpiece 1702, number of plates 1704, and first workpiece 1706 may be examples of physical implementations for positioning system 102, second workpiece 112, plate 134, and first workpiece 108 shown in block form in FIG. 1.

In this illustrative example, first workpiece 1706 may include first portion 1708 and second portion 1710, which may be examples of physical implementations for first portion 121 and second portion 123 of first workpiece 108 shown in block form in FIG. 1. Electromagnetic tool 218 in FIG. 2 may be used to attach first portion 1708 and second portion 1710 of first workpiece 1706 to form joint 1712 in this illustrative example.

As depicted, number of markings 1714 also may be arranged along first workpiece 1706 and second workpiece 1702. Number of markings 1714 may indicate where holes 122 shown in block form in FIG. 1 may be drilled in first workpiece 1706 and second workpiece 1702. Number of fasteners 120 may then be installed in holes 122.

In this illustrative example, each of number of plates 1704 may comprise a biasing system (not shown in this view). This biasing system may be comprised of a number of springs and engage second workpiece 1702 in the manner described above. A more-detailed view of section 1716 of positioning system 1700 may be seen in FIG. 18.

Figure 18:
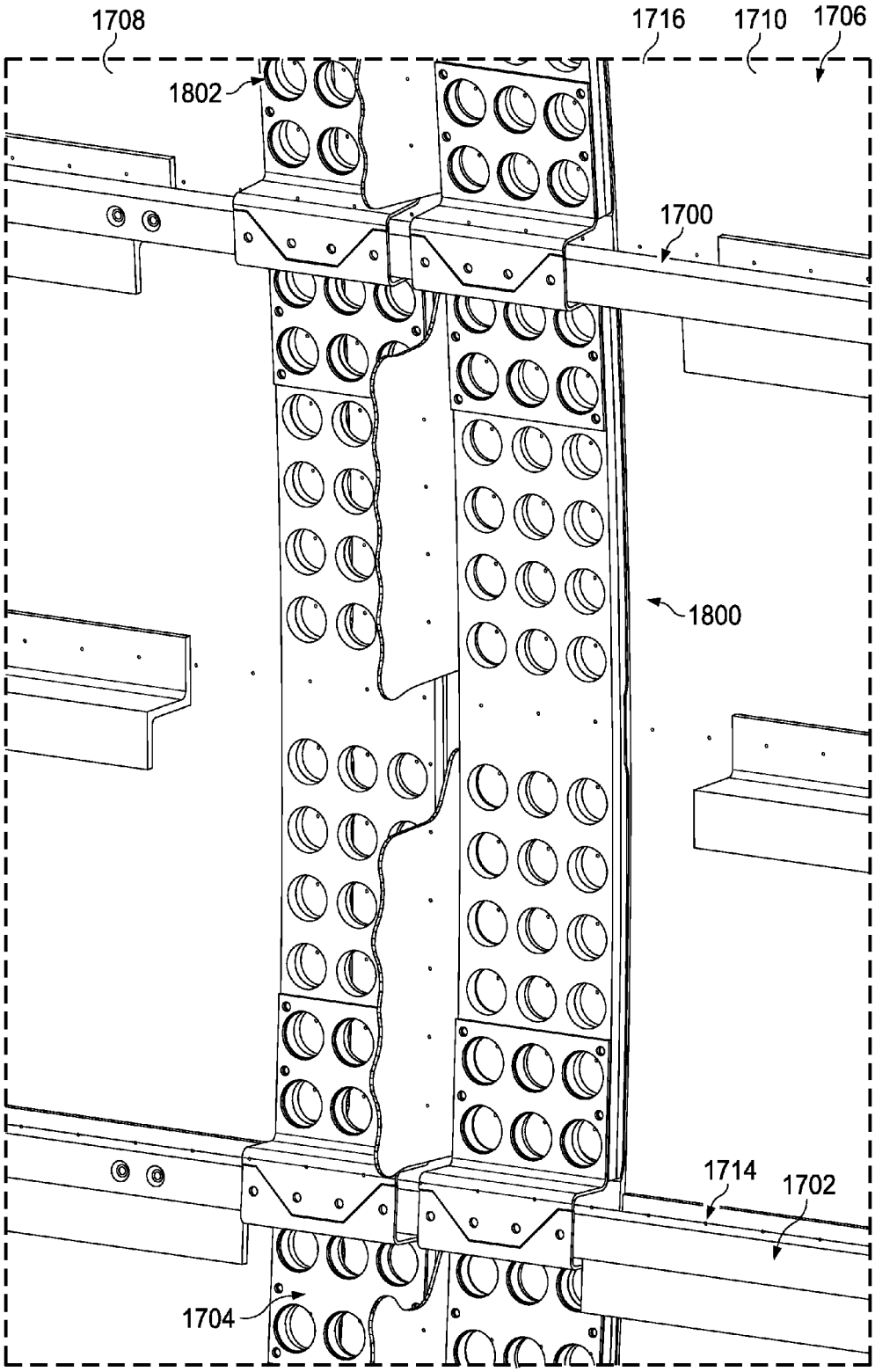
FIG. 18 is an illustration of a section of a positioning system engaged with a second workpiece in accordance with an illustrative embodiment.

In FIG. 18, an illustration of section 1716 of positioning system 1700 engaged with second workpiece 1702 from FIG. 17 is depicted in accordance with an illustrative embodiment. In this depicted example, number of plates 1704 may have plurality of openings 1800, which may be an example of one physical implementation for plurality of openings 164 shown in block form in FIG. 1.

In this illustrative example, plurality of openings 1800 may be arranged in rows 1802. Rows 1802 may comprise six rows in this illustrative example.

The illustrations of positioning system 216, positioning system 1000, positioning system 1600, and positioning system 1700 in FIGS. 2-18 are not meant to imply physical or architectural limitations to the manner in which an illustrative embodiment may be implemented. Other components in addition to or in place of the ones illustrated may be used. Some components may be optional.

For instance, although three rows are depicted for rows 402 in FIG. 4, a different number of rows 402 may be arranged along first workpiece 202. For example, without limitation, one row, five rows, ten rows, twelve rows, or some other number of rows 402 may be arranged along first workpiece 202, depending on the particular implementation.

In other illustrative examples, although plurality of openings 700 in FIG. 7 are shown as having a circular shape, plurality of openings also may have a different shape. For instance, plurality of openings 700 may have a triangular shape, a hexagonal shape, a rectangular shape, an octagonal shape, or some other suitable shape.

Further, the illustration of manufacturing environment 200 in FIG. 2 is not meant to limit the manner in which different illustrative embodiments may be implemented. For example, without limitation, robotic device 206 may position positioning system 216 and perform number of operations 114 such that human operator 180 may not be needed in manufacturing environment 200.

In other illustrative examples, first workpiece 202 may be comprised of more than two portions. For instance, in another illustrative example, a third portion (not shown in FIG. 2) may be present in first workpiece 202. In still other illustrative examples, lap joint 214 may be formed vertically along first workpiece 202 and second workpiece 204.

The different components shown in FIGS. 2-18 may be illustrative examples of how components shown in block form in FIG. 1 can be implemented as physical structures. Additionally, some of the components in FIGS. 2-18 may be combined with components in FIG. 1, used with components in FIG. 1, or a combination of the two.

Although the illustrative examples shown in FIGS. 1-18 are described with respect to an aircraft, an illustrative embodiment may be applied to other types of platforms. The platform may be, for example, without limitation, a mobile platform, a stationary platform, a land-based structure, an aquatic-based structure, and a space-based structure. More specifically, the platform, may be a surface ship, a tank, a personnel carrier, a train, a spacecraft, a space station, a satellite, a submarine, an automobile, a power plant, a bridge, a dam, a house, a manufacturing facility, a building, and other suitable platforms.

Figure 19:
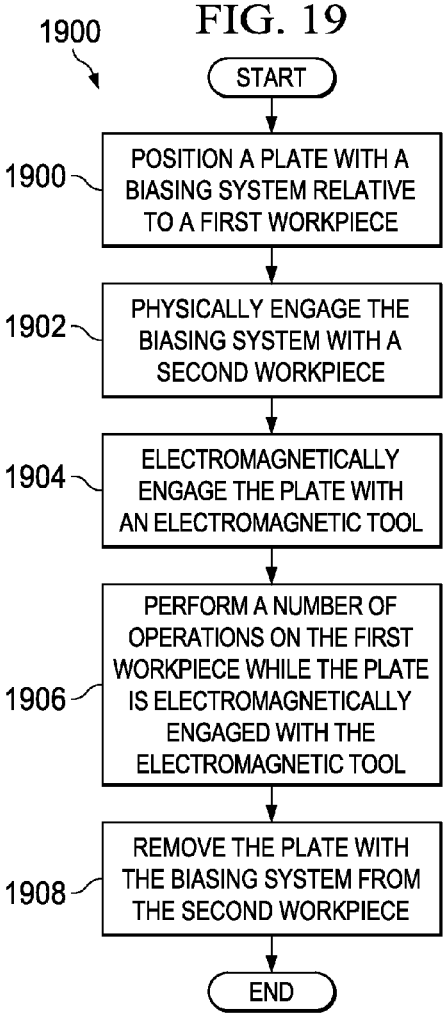
FIG. 19 is an illustration of a flowchart of a process for performing a number of operations with an electromagnetic tool in accordance with an illustrative embodiment.

With reference now to FIG. 19, an illustration of a flowchart of a process for performing number of operations 114 with electromagnetic tool 118 is depicted in accordance with an illustrative embodiment. The process described in FIG. 19 may be implemented by at least one of robotic device 178 or human operator 180 in manufacturing environment 100 shown in block form in FIG. 1. One or more of the different operations may be implemented using one or more components in positioning system 102 and electromagnetic tool 118 in FIG. 1.

The process begins by positioning plate 134 with biasing system 136 relative to first workpiece 108 (operation 1900). In some illustrative examples, more than one plate may be present in positioning system 102 and configured to be positioned relative to first workpiece 108.

In this case, first plate 166 physically associated with first biasing system 174 and second plate 168 physically associated with second biasing system 176 are both positioned relative to first workpiece 108. In some examples, group of connecting brackets 172 may be coupled to first plate 166 and second plate 168 to stabilize first plate 166 relative to second plate 168. In other illustrative examples, first plate 166 may engage second plate 168 at interface 170.

The process then physically engages biasing system 136 with second workpiece 112 (operation 1902). In this illustrative example, biasing system 136 may be engaged with second workpiece 112 such that plate 134 physically associated with biasing system 136 may be held in desired position 110 relative to first workpiece 108. When first plate 166 and second plate 168 are both present in positioning system 102, first biasing system and second biasing system 176 may be engaged with second workpiece 112.

Thereafter, the process electromagnetically engages plate 134 with electromagnetic tool 118 (operation 1904). In this illustrative example, electromagnetic tool 118 may be activated such that number of forces 126 caused by number of electromagnetic fields 128 clamps first workpiece 108 between electromagnetic tool 118 and plate 134.

The process then performs number of operations 114 on first workpiece 108 while plate 134 is electromagnetically engaged with electromagnetic tool 118 (operation 1906). For instance, electromagnetic tool 118 may guide number of fasteners 120 through plurality of openings 164 in plate 134 to form joint 125 between first portion 121 of first workpiece 108, second portion 123 of first workpiece 108, and second workpiece 112. In other illustrative examples, electromagnetic tool 118 may drill holes 122 or perform some other operations in number of operations 114.

Next, plate 134 with biasing system 136 is removed from second workpiece 112 (operation 1908), with the process terminating thereafter. In this depicted example, plate 134 with biasing system 136 may be removed by at least one of robotic device 178 or human operator 180. When more than one plate is present in positioning system 102, at least one of those plates may be removed. For instance, first plate 166 and second plate 168 may be removed from second workpiece 112.

Figure 20:
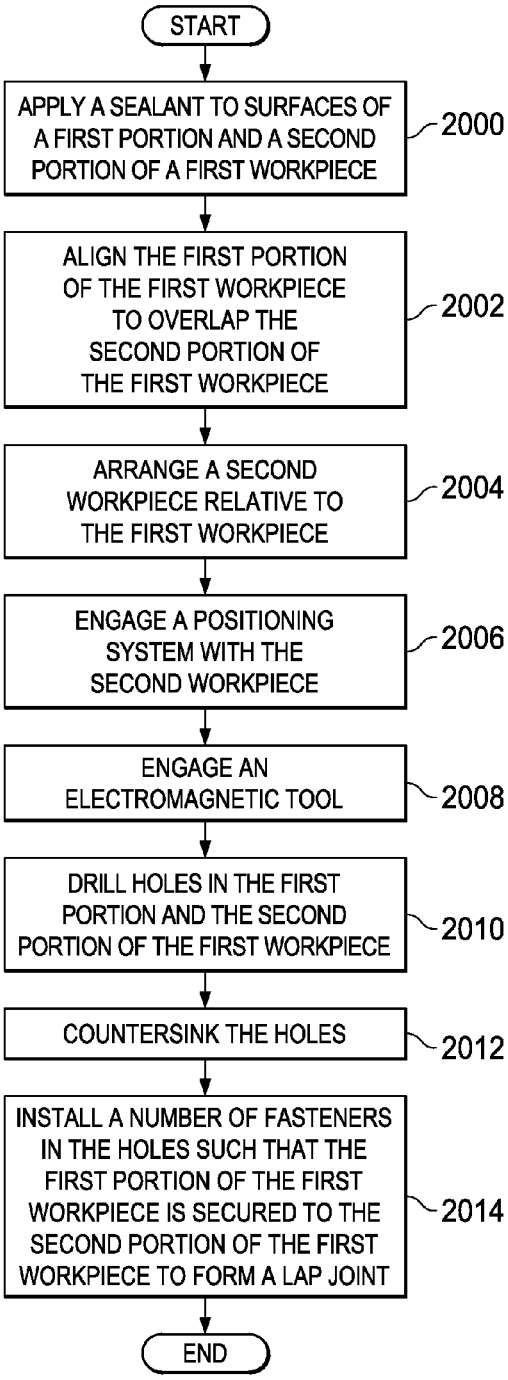
FIG. 20 is an illustration of a flowchart of a process for performing a number of operations on a first workpiece with an electromagnetic tool in accordance with an illustrative embodiment.

With reference now to FIG. 20, an illustration of a flowchart of a process for performing number of operations 114 on first workpiece 108 with electromagnetic tool 118 is depicted in accordance with an illustrative embodiment. The process described in FIG. 20 may be implemented by at least one of robotic device 178 or human operator 180 in manufacturing environment 100 shown in block form in FIG. 1. One or more of the different operations may be implemented using one or more components in positioning system 102 and electromagnetic tool 118 in FIG. 1.

The process may begin by applying a sealant to the surfaces of first portion 121 and second portion 123 of first workpiece 108 (operation 2000). In this illustrative example, a sealant may be applied to the surfaces of first portion 121 and second portion 123 that will overlap to form lap joint 214 in FIG. 2. These surfaces may be referred to as "faying surfaces" in this illustrative example.

Next, first portion 121 of first workpiece 108 may be aligned to overlap second portion 123 of first workpiece 108 (operation 2002). The process then may arrange second workpiece 112 relative to first workpiece 108 (operation 2004). Thereafter, positioning system 102 may be engaged with second workpiece 112 (operation 2006).

The process then may engage electromagnetic tool 118 (operation 2008). Electromagnetic tool 118 engages such that electromagnetic tool 118 clamps first portion 121 of first workpiece 108, second portion 123 of first workpiece 108, and second workpiece 112 together.

Next, the process may drill holes 122 in first portion 121 and second portion 123 of first workpiece 108 (operation 2010). Thereafter, the process may countersink holes 122 (operation 2012).

The process may then install number of fasteners 120 in holes 122 such that first portion 121 of first workpiece 108 is secured to second portion 123 of first workpiece 108 to form lap joint 214 (operation 2014) with the process terminating thereafter.

In some illustrative examples, holes 122 may be drilled in second workpiece 112 as well. In this case, number of fasteners 120 may be used to secure first portion 121 and second portion 123 of first workpiece 108 to second workpiece 112 to form lap joint 214, as described above.

With the use of tooling system 106 in manufacturing environment 100, number of operations 114 to form lap joint 214 in FIG. 2 may be completed more efficiently than with some currently used systems that include the steps of aligning first portion 121 of first workpiece 108 to overlap second portion 123 of first workpiece 108, locating and drilling holes 122, countersinking holes 122, separating and deburring first portion 121 and second portion 123, cleaning the surfaces of first portion 121 and second portion 123, applying sealant to surfaces of first portion 121 and second portion 123, re-aligning first portion 121 and second portion 123, squeezing out voids in the surface sealant, and installing number of fasteners 120 in holes 122. As can be seen, previously used systems may be complex and time-consuming.

With the use of an illustrative embodiment, however, one or more of the aforementioned steps for forming lap joint 214 may be simplified or eliminated. For example, without limitation, the surfaces of first workpiece 108 and second workpiece 112 may not need to be separated and deburred, realigned, and fastened. Instead, first portion 121 of first workpiece 108, second portion 123 of first workpiece 108, and second workpiece 112 may not need to be separated at all, thus saving valuable time and reducing the potential for inconsistencies to occur. As a result, manufacturing of aircraft 104 may occur more quickly than before.

Further, with the use of an illustrative embodiment, human operator intervention may be reduced or eliminated. For instance, because the process for forming lap joint 214 is simplified, the process may be automated using robotic device 178 in FIG. 1 or some other suitable type of automation. Some previously used methods for forming a lap joint preclude automation due to the complexity of the method and need for human operator intervention.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, without limitation, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Figure 21:
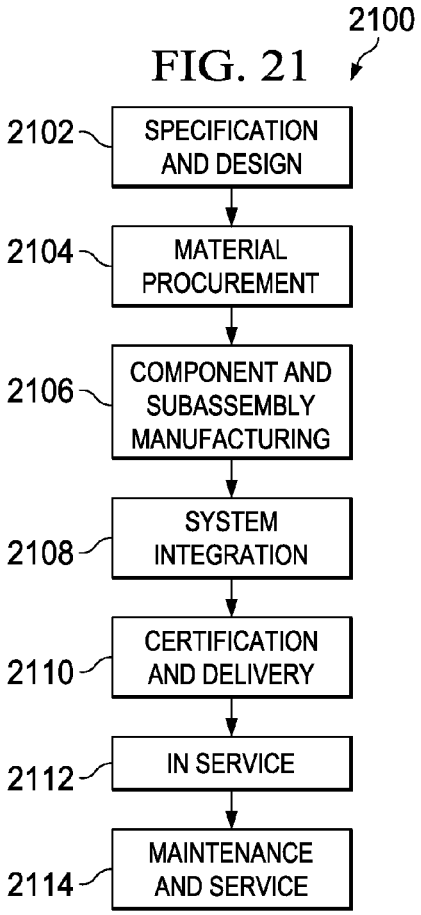
FIG. 21 is an illustration of a block diagram of an aircraft manufacturing and service method in accordance with an illustrative embodiment.
Figure 22:
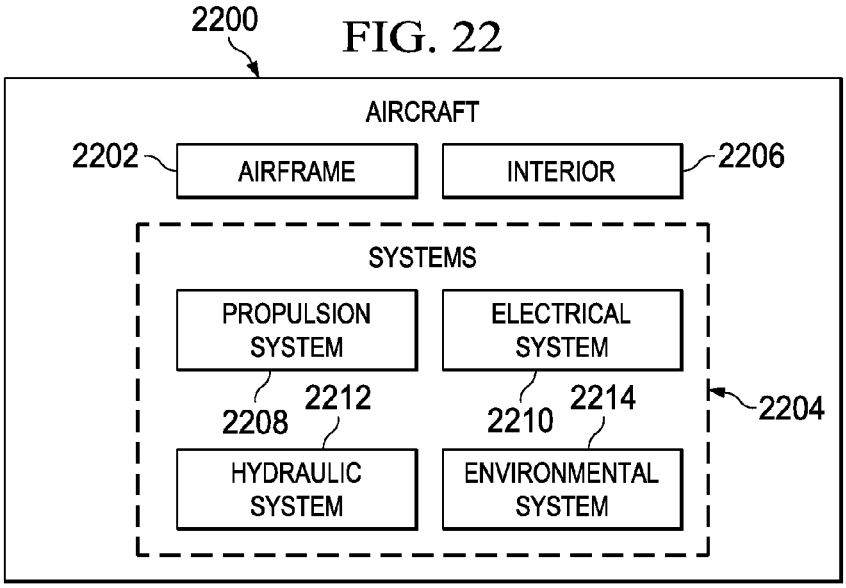
FIG. 22 is an illustration of a block diagram of an aircraft in which an illustrative embodiment may be implemented.

Illustrative embodiments of the disclosure may be described in the context of aircraft manufacturing and service method 2100 as shown in FIG. 21 and aircraft 2200 as shown in FIG. 22. For example, without limitation, the components shown in block form in FIG. 1 may be used during aircraft manufacturing and service method 2100 to manufacture aircraft 2200.

Turning first to FIG. 21, an illustration of an aircraft manufacturing and service method is depicted in accordance with an illustrative embodiment. During pre-production, aircraft manufacturing and service method 2100 may include specification and design 2102 of aircraft 2200 in FIG. 22 and material procurement 2104.

During production, component and subassembly manufacturing 2106 and system integration 2108 of aircraft 2200 in FIG. 22 takes place. Thereafter, aircraft 2200 in FIG. 22 may go through certification and delivery 2110 in order to be placed in service 2112. While in service 2112 by a customer, aircraft 2200 in FIG. 22 is scheduled for routine maintenance and service 2114, which may include modification, reconfiguration, refurbishment, and other maintenance or service.

Each of the processes of aircraft manufacturing and service method 2100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 22, an illustration of a block diagram of an aircraft is depicted in which an illustrative embodiment may be implemented. In this example, aircraft 2200 is produced by aircraft manufacturing and service method 2100 in FIG. 21 and may include airframe 2202 with plurality of systems 2204 and interior 2206. Examples of systems 2204 include one or more of propulsion system 2208, electrical system 2210, hydraulic system 2212, and environmental system 2214. Any number of other systems may be included. Although an aerospace example is shown, different illustrative embodiments may be applied to other industries, such as the automotive industry.

In one illustrative example, components or subassemblies produced in component and subassembly manufacturing 2106 in FIG. 21 may be fabricated or manufactured in a manner similar to components or subassemblies produced while aircraft 2200 is in service 2112 in FIG. 21. As yet another example, one or more apparatus embodiments, method embodiments, or a combination thereof may be utilized during production stages, such as component and subassembly manufacturing 2106 and system integration 2108 in FIG. 21. One or more apparatus embodiments, method embodiments, or a combination thereof may be utilized while aircraft 2200 is in service 2112 and/or during maintenance and service 2114 in FIG. 21. The use of a number of the different illustrative embodiments may substantially expedite the assembly of and/or reduce the cost of aircraft 2200.

Apparatuses and methods embodied herein may be employed during at least one of the stages of aircraft manufacturing and service method 2100 in FIG. 21. In particular, positioning system 102 from FIG. 1 may be used during any one of the stages of aircraft manufacturing and service method 2100. For example, without limitation, positioning system 102 from FIG. 1 may be used during at least one of component and subassembly manufacturing 2106, system integration 2108, routine maintenance and service 2114, or some other stage of aircraft manufacturing and service method 2100.

For instance, in one illustrative example, plate 134 with biasing system 136 in positioning system 102 may be engaged with a workpiece to stabilize the workpiece relative to other components during component and subassembly manufacturing 2106. In other illustrative examples, plate 134 with biasing system 136 may be used to rework structures for aircraft 2200 during routine maintenance and service.

Thus, the illustrative embodiments may provide a method and apparatus for positioning system 102 for electromagnetic riveting. Positioning system 102 comprises plate 134 and biasing system 136. Plate 134 may be configured to be positioned relative to first workpiece 108 and electromagnetically engage electromagnetic tool 118. Biasing system 136 may be physically associated with plate 134 and may be configured to physically engage second workpiece 112. Biasing system 136 may be further configured to hold plate 134 in desired position 110 relative to first workpiece 108 during number of operations 114 performed by electromagnetic tool 118 while plate 134 is electromagnetically engaged with first workpiece 108.

The illustrative embodiments may provide a positioning system that is more versatile and takes less time to use than some currently used positioning systems. Plate 134 with biasing system 136 may hold first workpiece 108 in desired position 110 such that joint 125 may be formed in a desired manner. As a result, rework at joint 125 may be reduced or eliminated.

Additionally, because biasing system 136 may have number of springs 140, biasing system 136 may be more easily engaged with second workpiece 112 than currently used positioning systems that may be secured to one of first workpiece 108 and second workpiece 112 using fasteners. After electromagnetic tool 118 completes number of operations 114, plate 134 with number of springs 140 may be more easily removed from second workpiece 112 than positioning systems where fasteners need to be removed.

Moreover, additional holes 122 may not be needed in first workpiece 108 such that the structural integrity of first workpiece 108 may be maintained at a desired level. Accordingly, less rework and maintenance may be needed at joint 125 in these illustrative examples and therefore, the cost and assembly time needed for aircraft 104 may be reduced.

Additionally, illustrative embodiments provide a more efficient method to install number of fasteners 120 in holes 122 to secure first workpiece 108 to second workpiece 112 than with some currently used methods. With the use of an illustrative embodiment, drilling, countersinking, and installation of fasteners 120 in holes 122 may occur without additional processing steps and without deactivating electromagnetic tool 118. As a result, aircraft 104 may be assembled more quickly than before and with a higher degree of precision.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a plate configured to be positioned relative to a first workpiece and to electromagnetically engage an electromagnetic tool; and a biasing system physically associated with the plate and configured to physically engage a second workpiece and hold the plate in a desired position relative to the first workpiece during a number of operations performed by the electromagnetic tool while the plate is electromagnetically engaged with the first workpiece.

2. The apparatus of claim 1, wherein the electromagnetic tool is configured to attach the first workpiece to the second workpiece using a number of fasteners.

3. The apparatus of claim 1, wherein the biasing system is configured to physically engage the second workpiece and hold the plate in the desired position relative to the first workpiece in a number of directions.

4. The apparatus of claim 1, wherein the biasing system comprises:

a number of springs configured to stabilize the plate in a number of directions by locking the biasing system in place with a number of structures in the second workpiece.

5. The apparatus of claim 4, wherein the number of springs is configured into pairs of springs, each pair of springs configured to stabilize the plate in a respective direction selected from at least one of an x-direction, a y-direction, or a z-direction.

6. The apparatus of claim 4, wherein a spring in the number of springs is selected from one of a plate spring, a compression spring, a torsion spring, a flat spring, a leaf spring, a coil spring, a helical spring, or a cantilever spring.

7. The apparatus of claim 1, wherein the desired position of the plate is selected from at least one of being in contact with a surface of the first workpiece and a desired distance from the first workpiece.

8. The apparatus of claim 1, wherein the plate is a backing plate and further comprising:

a plurality of openings in the backing plate configured to receive a number of fasteners during operation of the electromagnetic tool.

9. The apparatus of claim 1, wherein the plate is a first plate and the biasing system is a first biasing system, and further comprising:

a second plate configured to engage with the first plate at an interface; and a second biasing system physically associated with the second plate and configured to hold the second plate in the desired position relative to the first workpiece during the number of operations performed by the electromagnetic tool.

10. The apparatus of claim 9 further comprising:

a group of connecting brackets coupled to the first plate and the second plate and configured to stabilize the first plate relative to at least one of the first workpiece or the second plate.

11. The apparatus of claim 1, wherein the electromagnetic tool is an electromagnetic riveting tool.

12. The apparatus of claim 1, wherein the first workpiece is a skin of a fuselage of an aircraft and the second workpiece is a structural portion of the fuselage of the aircraft.

13. The apparatus of claim 1, wherein the biasing system stabilizes the plate against a number of structures in the second workpiece, wherein the number of structures is selected from at least one of a stringer, a frame, or a shear tie.

14. The apparatus of claim 1, wherein the number of operations is selected from at least one of drilling a hole, installing a fastener in the hole, countersinking a hole, or applying a coating to a surface of the first workpiece.

15. The apparatus of claim 1, wherein the plate and the biasing system form a positioning system.

16. A system comprising:

an electromagnetic tool configured to perform a number of operations on a first workpiece and a second workpiece, in which the number of operations is selected from at least one of drilling a hole, installing a fastener in the hole, countersinking a hole, or applying a coating to a surface of the first workpiece and in which the electromagnetic tool is an electromagnetic riveting tool and in which the first workpiece is a skin of a fuselage and the second workpiece is a structural portion of the fuselage;

a first plate configured to be positioned relative to the first workpiece in a position selected from at least one of being in contact with the surface of the first workpiece and a desired distance from the first workpiece and configured to electromagnetically engage the electromagnetic tool, in which the first plate is a backing plate and further comprises a plurality of openings in the backing plate configured to receive a number of fasteners during operation of the electromagnetic tool;

a first biasing system physically associated with the first plate and configured to physically engage the second workpiece and hold the first plate in a desired position relative to the first workpiece and the second workpiece in a number of directions during the number of operations performed by the electromagnetic tool while the first plate is electromagnetically engaged with the first workpiece and the second workpiece, in which the first biasing system comprises a number of springs configured into pairs of springs and is used to stabilize the first plate in the number of directions by locking the first biasing system in place with a number of structures in the second workpiece, each pair of springs configured to stabilize the first plate in a respective direction selected from at least one of an x-direction, a y-direction, or a z-direction, in which a spring in the number of springs is selected from one of a plate spring, a compression spring, a torsion spring, a flat spring, a leaf spring, a coil spring, a helical spring, or a cantilever spring, in which the first biasing system stabilizes the plate against the number of structures in the second workpiece, wherein the number of structures is selected from at least one of a stringer, a frame, or a shear tie;

a second plate configured to engage with the first plate at an interface;

a second biasing system physically associated with the second plate and configured to hold the second plate in the desired position relative to the first workpiece and the second workpiece during the number of operations performed by the electromagnetic tool; and a group of connecting brackets coupled to the first plate and the second plate and configured to stabilize the first plate relative to at least one of the second workpiece or the second plate, in which the first plate, the second plate, the first biasing system, the second biasing system, and the group of connecting brackets form a positioning system.

17. A method for performing a number of operations with an electromagnetic tool, the method comprising:

physically engaging a biasing system with a second workpiece in which a plate physically associated with the biasing system is held in a desired position relative to a first workpiece;

electromagnetically engaging the plate with the electromagnetic tool; and performing the number of operations on the first workpiece while the plate is electromagnetically engaged with the electromagnetic tool.

18. The method of claim 17, wherein the biasing system comprises:

a number of springs physically associated with the plate and configured to hold the plate in the desired position relative to the first workpiece in a number of directions.

19. The method of claim 18, wherein physically engaging the biasing system with the second workpiece comprises:

locking the number of springs of the biasing system in place with a number of structures in the second workpiece.

20. The method of claim 18, wherein the number of springs is configured into pairs of springs.

21. The method of claim 20, wherein each pair of springs in the number of springs is configured to stabilize the plate in a respective direction selected from at least one of an x-direction, a y-direction, or a z-direction.

22. The method of claim 20, wherein the number of springs is selected from one of a plate spring, a compression spring, a torsion spring, a flat spring, a leaf spring, a coil spring, a helical spring, or a cantilever spring.

23. The method of claim 17 further comprising:

performing the number of operations on the second workpiece while the plate is electromagnetically engaged with the electromagnetic tool.

24. The method of claim 17, wherein performing the number of operations on the first workpiece while the plate is electromagnetically engaged with the electromagnetic tool comprises:

drilling holes in a first portion and a second portion of the first workpiece;

countersinking the holes; and installing fasteners in the holes such that the first portion of the first workpiece is secured to the second portion of the first workpiece to form a lap joint.

25. The method of claim 17, wherein the plate comprises a plurality of openings configured to receive a number of fasteners and performing the number of operations comprises:

guiding the number of fasteners through the plurality of openings in the plate to form a joint between the first workpiece and the second workpiece using the electromagnetic tool.

26. The method of claim 17, wherein the plate is a first plate and further comprising:

positioning a second plate physically associated with a second biasing system relative to the first plate, wherein a group of connecting brackets is coupled to the first plate and the second plate and configured to stabilize the first plate relative to at least one of the first workpiece or the second plate.

27. The method of claim 17 further comprising:

removing the plate with the biasing system from the second workpiece.

28. The method of claim 17, wherein the biasing system stabilizes the plate against a number of structures in the second workpiece selected from at least one of a stringer, a frame, or a shear tie.

29. The method of claim 17, wherein the number of operations is selected from at least one of drilling a hole, installing a fastener in the hole, countersinking a hole, or applying a coating to a surface of the first workpiece.

30. A method for performing a number of operations with an electromagnetic tool, the method comprising:

physically engaging a biasing system with a second workpiece including locking a number of springs of the biasing system in place with a number of structures in the second workpiece, in which a plate physically associated with the biasing system is held in a desired position relative to a first workpiece to stabilize the plate against the number of structures in the second workpiece selected from at least one of a stringer, a frame, or a shear tie, the biasing system comprising the number of springs physically associated with the plate and configured to hold the plate in the desired position relative to the first workpiece in a number of directions, in which the number of springs is configured into pairs of springs, each pair of springs in the number of springs configured to stabilize the plate in a respective direction selected from at least one of an x-direction, a y-direction, or a z-direction;

electromagnetically engaging the plate with the electromagnetic tool in which the plate comprises a plurality of openings configured to receive a number of fasteners in which the plate is a first plate;

positioning a second plate physically associated with a second biasing system relative to the first plate in which a group of connecting brackets is coupled to the first workpiece and the second plate and is configured to stabilize the first plate relative to at least one of the second plate and the second workpiece;

performing the number of operations on the first workpiece while the plate is electromagnetically engaged with the electromagnetic tool in which performing the number of operations comprises guiding the number of fasteners through the plurality of openings in the plate to form a joint between the first workpiece and the second workpiece using the electromagnetic tool;

performing the number of operations on the second workpiece while the plate is electromagnetically engaged with the electromagnetic tool, in which performing the number of operations on the first workpiece comprises drilling holes in a first portion and a second portion of the first workpiece; countersinking the holes; and installing fasteners in the holes such that the first portion of the first workpiece is secured to the second portion of the first workpiece to form a lap joint; and removing the first plate, the second plate, and the biasing system from the first workpiece and the second workpiece.

* * * * *